US010892544B2

(12) United States Patent
Pance et al.

(10) Patent No.: US 10,892,544 B2
(45) Date of Patent: Jan. 12, 2021

(54) DIELECTRIC RESONATOR ANTENNA HAVING FIRST AND SECOND DIELECTRIC PORTIONS

(71) Applicant: Rogers Corporation, Chandler, AZ (US)

(72) Inventors: Kristi Pance, Auburndale, MA (US); Gianni Taraschi, Arlington, MA (US)

(73) Assignee: ROGERS CORPORATION, Chandler, AZ (US)

( * ) Notice: Subject to any disclaimer, the term of this patent is extended or adjusted under 35 U.S.C. 154(b) by 40 days.

(21) Appl. No.: 16/246,880

(22) Filed: Jan. 14, 2019

(65) Prior Publication Data

US 2019/0221926 A1 Jul. 18, 2019

Related U.S. Application Data

(60) Provisional application No. 62/617,358, filed on Jan. 15, 2018.

(51) Int. Cl.
*H01Q 1/36* (2006.01)
*H01Q 19/06* (2006.01)
(Continued)

(52) U.S. Cl.
CPC ..... *H01Q 1/36* (2013.01); *H01Q 9/0485* (2013.01); *H01Q 15/08* (2013.01); *H01Q 15/14* (2013.01); *H01Q 19/06* (2013.01); *H01Q 21/061* (2013.01)

(58) Field of Classification Search
None
See application file for complete search history.

(56) References Cited

U.S. PATENT DOCUMENTS 2,624,002 A 10/1952 Bouix
3,321,765 A 5/1967 Peters et al.
(Continued)

FOREIGN PATENT DOCUMENTS

EP 0468413 A2 1/1992
EP 0587247 A1 3/1994
(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5,, No. 1, Jan. 2007; pp. 479-481.
(Continued)

*Primary Examiner* — Jany Richardson
(74) *Attorney, Agent, or Firm* — Cantor Colburn LLP

(57) ABSTRACT

A dielectric structure of an electromagnetic device includes: a first dielectric portion, FDP, having a proximal end, a distal end, and a three-dimensional, 3D, shape having a direction of protuberance from the proximal end to the distal end oriented parallel with a z-axis of an orthogonal x, y, z coordinate system; and a second dielectric portion, SDP, having a proximal end and a distal end, the proximal end of the SDP being disposed proximate the distal end of the FDP, the FDP and the SDP having a dielectric material other than air; wherein the SDP has a 3D shape having a first x-y plane cross-section area proximate the proximal end of the SDP, and a second x-y plane cross-section area between the proximal end and the distal end of the SDP, the second x-y plane cross section area being greater than the first x-y plane cross-section area.

31 Claims, 21 Drawing Sheets

(51) Int. Cl.

| | |
|---|---|
| ***H01Q 15/08*** | (2006.01) |
| ***H01Q 9/04*** | (2006.01) |
| ***H01Q 15/14*** | (2006.01) |
| ***H01Q 21/06*** | (2006.01) |

(56) References Cited

U.S. PATENT DOCUMENTS

| | | | |
|---|---|---|---|
| 4,366,484 | A | 12/1982 | Weiss et al. |
| 4,743,915 | A | 5/1988 | Rammos et al. |
| 5,227,749 | A | 7/1993 | Raguenet et al. |
| 5,453,754 | A | 9/1995 | Fray |
| 5,589,842 | A | 12/1996 | Wang et al. |
| 5,667,796 | A | 9/1997 | Otten |
| 5,854,608 | A | 12/1998 | Leisten |
| 5,940,036 | A | 8/1999 | Oliver et al. |
| 5,952,972 | A | 9/1999 | Ittipiboon et al. |
| 6,031,433 | A | 2/2000 | Tanizaki et al. |
| 6,052,087 | A | 4/2000 | Ishikawa et al. |
| 6,061,026 | A | 5/2000 | Ochi et al. |
| 6,061,031 | A | 5/2000 | Cosenza et al. |
| 6,147,647 | A | 11/2000 | Tassoudji et al. |
| 6,181,297 | B1 | 1/2001 | Leisten |
| 6,188,360 | B1 | 2/2001 | Kato et al. |
| 6,198,450 | B1 | 3/2001 | Adachi et al. |
| 6,268,833 | B1 | 7/2001 | Tanizaki et al. |
| 6,292,141 | B1 | 9/2001 | Lim |
| 6,314,276 | B1 | 11/2001 | Hilgers et al. |
| 6,317,095 | B1 | 11/2001 | Teshirogi et al. |
| 6,323,808 | B1 | 11/2001 | Heinrichs et al. |
| 6,323,824 | B1 | 11/2001 | Heinrichs et al. |
| 6,344,833 | B1 | 2/2002 | Lin et al. |
| 6,373,441 | B1 | 4/2002 | Porath et al. |
| 6,437,747 | B1 | 8/2002 | Stoiljkovic et al. |
| 6,476,774 | B1 | 11/2002 | Davidson et al. |
| 6,528,145 | B1 | 3/2003 | Berger et al. |
| 6,552,687 | B1 | 4/2003 | Rawnick et al. |
| 6,556,169 | B1 | 4/2003 | Fukuura et al. |
| 6,621,381 | B1 | 9/2003 | Kundu et al. |
| 6,743,744 | B1 | 6/2004 | Kim et al. |
| 6,794,324 | B1 | 9/2004 | Kim et al. |
| 6,816,118 | B2 | 11/2004 | Kingsley et al. |
| 6,816,128 | B1 | 11/2004 | Jennings |
| 7,161,535 | B2 | 1/2007 | Palmer et al. |
| 7,179,844 | B2 | 2/2007 | Aki et al. |
| 7,183,975 | B2 | 2/2007 | Thomas et al. |
| 7,196,663 | B2 | 3/2007 | Bozer et al. |
| 7,253,789 | B2 | 8/2007 | Kingsley et al. |
| 7,292,204 | B1 | 11/2007 | Chang et al. |
| 7,310,031 | B2 | 12/2007 | Pance et al. |
| 7,379,030 | B1 | 5/2008 | Lier |
| 7,382,322 | B1 | 6/2008 | Yang et al. |
| 7,443,363 | B2 | 10/2008 | Ying |
| 7,498,969 | B1 | 3/2009 | Paulsen et al. |
| 7,545,327 | B2 | 6/2009 | Iellici et al. |
| 7,570,219 | B1 | 8/2009 | Paulsen et al. |
| 7,595,765 | B1 | 9/2009 | Hirsch et al. |
| 7,636,063 | B2 | 12/2009 | Channabasappa |
| 7,663,553 | B2 | 2/2010 | Chang et al. |
| 7,710,325 | B2 | 5/2010 | Cheng |
| 7,961,148 | B2 | 6/2011 | Goldberger |
| 8,098,197 | B1 | 1/2012 | Herting et al. |
| 8,498,539 | B1 | 7/2013 | Iichenko et al. |
| 8,736,502 | B1 | 5/2014 | Langfield et al. |
| 8,773,319 | B1 | 7/2014 | Anderson et al. |
| 8,902,115 | B1 | 12/2014 | Loui et al. |
| 9,112,273 | B2 | 8/2015 | Christie et al. |
| 9,184,697 | B2 | 11/2015 | Sekiguchi et al. |
| 9,225,070 | B1 | 12/2015 | Zeweri et al. |
| 9,608,330 | B2 | 3/2017 | Singleton et al. |
| 9,825,373 | B1 | 11/2017 | Smith |
| 10,355,361 | B2 | 7/2019 | Pance et al. |
| 10,522,917 | B2 | 12/2019 | Pance et al. |
| 10,587,039 | B2 | 3/2020 | Pance et al. |
| 2001/0013842 | A1 | 8/2001 | Ishikawa et al. |
| 2001/0043158 | A1 | 11/2001 | Adachi et al. |
| 2002/0000947 | A1 | 1/2002 | Al-Rawi et al. |
| 2002/0057138 | A1 | 5/2002 | Takagi et al. |
| 2002/0180646 | A1 | 12/2002 | Kivekas et al. |
| 2002/0196190 | A1 | 12/2002 | Lim |
| 2003/0016176 | A1 | 1/2003 | Kingsley et al. |
| 2003/0034922 | A1 | 2/2003 | Isaacs et al. |
| 2003/0043075 | A1 | 3/2003 | Bit-Babik et al. |
| 2003/0122729 | A1 | 7/2003 | Diaz et al. |
| 2003/0151548 | A1 | 8/2003 | Kingsley et al. |
| 2003/0181312 | A1 | 9/2003 | Mailadil et al. |
| 2004/0029709 | A1 | 2/2004 | Oba et al. |
| 2004/0036148 | A1 | 2/2004 | Block et al. |
| 2004/0051602 | A1 | 3/2004 | Pance et al. |
| 2004/0080455 | A1 | 4/2004 | Lee |
| 2004/0113843 | A1 | 6/2004 | Le Bolzer et al. |
| 2004/0119646 | A1 | 6/2004 | Ohno et al. |
| 2004/0127248 | A1 | 7/2004 | Lin et al. |
| 2004/0130489 | A1 | 7/2004 | Le Bolzer et al. |
| 2004/0155817 | A1 | 8/2004 | Kingsley et al. |
| 2004/0233107 | A1 | 11/2004 | Popov et al. |
| 2004/0263422 | A1 | 12/2004 | Lynch |
| 2005/0017903 | A1 | 1/2005 | Ittipiboon et al. |
| 2005/0024271 | A1 | 2/2005 | Ying et al. |
| 2005/0057402 | A1 | 3/2005 | Ohno et al. |
| 2005/0099348 | A1 | 5/2005 | Pendry |
| 2005/0122273 | A1 | 6/2005 | Legay et al. |
| 2005/0162316 | A1 | 7/2005 | Thomas et al. |
| 2005/0179598 | A1 | 8/2005 | Legay et al. |
| 2005/0200531 | A1 | 9/2005 | Huang et al. |
| 2005/0219130 | A1 | 10/2005 | Koch et al. |
| 2005/0225499 | A1 | 10/2005 | Kingsley et al. |
| 2005/0242996 | A1 | 11/2005 | Palmer et al. |
| 2005/0264449 | A1 | 12/2005 | Strickland |
| 2005/0264451 | A1 | 12/2005 | Aikawa et al. |
| 2006/0022875 | A1 | 2/2006 | Pidwerbetsky et al. |
| 2006/0119518 | A1 | 6/2006 | Ohmi et al. |
| 2006/0145705 | A1 | 7/2006 | Raja |
| 2006/0194690 | A1 | 8/2006 | Osuzu |
| 2006/0232474 | A1 | 10/2006 | Fox |
| 2006/0293651 | A1 | 12/2006 | Cronin |
| 2007/0152884 | A1 | 7/2007 | Bouche et al. |
| 2007/0164420 | A1 | 7/2007 | Chen et al. |
| 2007/0252778 | A1 | 11/2007 | Ide et al. |
| 2008/0036675 | A1 | 2/2008 | Fujieda |
| 2008/0042903 | A1 | 2/2008 | Cheng |
| 2008/0048915 | A1 | 2/2008 | Chang et al. |
| 2008/0094309 | A1 | 4/2008 | Pance et al. |
| 2008/0122703 | A1 | 5/2008 | Ying |
| 2008/0129616 | A1 | 6/2008 | Li et al. |
| 2008/0129617 | A1 | 6/2008 | Li et al. |
| 2008/0260323 | A1 | 10/2008 | Jalali et al. |
| 2008/0272963 | A1 | 11/2008 | Chang et al. |
| 2008/0278378 | A1 | 11/2008 | Chang et al. |
| 2009/0040131 | A1 | 2/2009 | Mosallaei |
| 2009/0073332 | A1 | 3/2009 | Irie |
| 2009/0102739 | A1 | 4/2009 | Chang et al. |
| 2009/0128262 | A1 | 5/2009 | Lee et al. |
| 2009/0128434 | A1 | 5/2009 | Chang et al. |
| 2009/0140944 | A1 | 6/2009 | Chang et al. |
| 2009/0153403 | A1 | 6/2009 | Chang et al. |
| 2009/0179810 | A1 | 7/2009 | Kato et al. |
| 2009/0184875 | A1 | 7/2009 | Chang et al. |
| 2009/0206957 | A1 | 8/2009 | Hiroshima et al. |
| 2009/0262022 | A1 | 10/2009 | Ying |
| 2009/0270244 | A1 | 10/2009 | Chen et al. |
| 2009/0305652 | A1 | 12/2009 | Boffa et al. |
| 2010/0051340 | A1 | 3/2010 | Yang et al. |
| 2010/0103052 | A1 | 4/2010 | Ying |
| 2010/0220024 | A1 | 9/2010 | Snow et al. |
| 2011/0012807 | A1 | 1/2011 | Sorvala |
| 2011/0050367 | A1 | 3/2011 | Yen et al. |
| 2011/0121258 | A1 | 5/2011 | Hanein et al. |
| 2011/0122036 | A1 | 5/2011 | Leung et al. |
| 2011/0133991 | A1 | 6/2011 | Lee et al. |
| 2011/0248890 | A1 | 10/2011 | Lee et al. |
| 2012/0092219 | A1 | 4/2012 | Kim |
| 2012/0212386 | A1 | 8/2012 | Massie et al. |
| 2012/0242553 | A1 | 9/2012 | Leung et al. |
| 2012/0245016 | A1 | 9/2012 | Curry et al. |

(56) References Cited

U.S. PATENT DOCUMENTS

2012/0256796 A1 10/2012 Leiba
2012/0274523 A1 11/2012 Ayatollahi
2012/0276311 A1 11/2012 Chirila
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0234898 A1 9/2013 Leung et al.
2013/0278610 A1 10/2013 Stephanou et al.
2014/0043189 A1 2/2014 Lee et al.
2014/0327591 A1 11/2014 Kokkinos
2014/0327597 A1 11/2014 Rashidian et al.
2015/0035714 A1 2/2015 Zhou
2015/0077198 A1 3/2015 Yatabe
2015/0138036 A1 4/2015 Harper
2015/0207233 A1 7/2015 Kim et al.
2015/0207234 A1 7/2015 Ganchrow et al.
2015/0236428 A1 8/2015 Caratelli et al.
2015/0244082 A1 8/2015 Caratelli et al.
2015/0303546 A1 10/2015 Rashidian et al.
2015/0314526 A1 11/2015 Cohen
2015/0346334 A1* 12/2015 Nagaishi ..... H01Q 1/421 342/115
2015/0380824 A1 12/2015 Tayfeh Aligodarz et al.
2016/0111769 A1 4/2016 Pance et al.
2016/0218437 A1 7/2016 Guntupalli et al.
2016/0294066 A1 10/2016 Djerafi et al.
2016/0294068 A1 10/2016 Djerafi et al.
2016/0322708 A1 11/2016 Tayfeh Aligodarz et al.
2016/0351996 A1 12/2016 Ou
2016/0372955 A1 12/2016 Fackelmeier et al.
2017/0018851 A1 1/2017 Henry et al.
2017/0040700 A1 2/2017 Leung et al.
2017/0110804 A1* 4/2017 Henry ..... H01Q 19/062
2017/0125901 A1 5/2017 Sharawi et al.
2017/0125908 A1 5/2017 Pance et al.
2017/0125909 A1 5/2017 Pance et al.
2017/0125910 A1 5/2017 Pance et al.
2017/0179569 A1 6/2017 Kim et al.
2017/0188874 A1 7/2017 Suhami
2017/0271772 A1 9/2017 Miraftab et al.
2017/0272149 A1 9/2017 Michaels
2018/0115072 A1 4/2018 Pance et al.
2018/0309202 A1 10/2018 Pance et al.
2018/0323514 A1 11/2018 Pance et al.
2019/0020105 A1 1/2019 Pance et al.
2019/0214732 A1 7/2019 Leung et al.
2019/0319357 A1 10/2019 Pance et al.
2019/0379123 A1 12/2019 Leung et al.
2019/0393607 A1 12/2019 Pance et al.
2020/0083609 A1 3/2020 Pance et al.

FOREIGN PATENT DOCUMENTS

EP 0801436 A2 10/1997
EP 1783516 A1 5/2007
EP 2905632 A1 8/2015
JP 2004112131 A 4/2004
WO 2017075184 A1 5/2017

OTHER PUBLICATIONS

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

Zainud-Deen, S H et al; "Dielectric Resonator Antenna Phased Array for Fixed RFID Reader in Near Field Region"; IEEE; Mar. 6, 2012; pp. 102-107.

Notification of Transmittal of the International Search Report and the Written Opinion of the International Searching Authority, or the Declaration for International Application No. PCT/US2019/013576; Report dated Mar. 27, 2019; Report Received: Apr. 3, 2019; 19 pages. (related to U.S. Appl. No. 16/246,880).

* cited by examiner

DIELECTRIC RESONATOR ANTENNA HAVING FIRST AND SECOND DIELECTRIC PORTIONS

CROSS REFERENCE TO RELATED APPLICATIONS

This application claims the benefit of U.S. Provisional Application Ser. No. 62/617,358, filed Jan. 15, 2018, which is incorporated herein by reference in its entirety.

BACKGROUND OF THE INVENTION

The present disclosure relates generally to an electromagnetic device, particularly to a dielectric resonator antenna (DRA) system, and more particularly to a DRA system having first and second dielectric portions for enhancing the gain, return loss and isolation associated with a plurality of dielectric structures within the DRA system.

While existing DRA resonators and arrays may be suitable for their intended purpose, the art of DRAs would be advanced with an improved DRA structure for building a high gain DRA system with high directionality in the far field that can overcome existing drawbacks, such as limited bandwidth, limited efficiency, limited gain, limited directionality, or complex fabrication techniques, for example.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment includes an electromagnetic device having a dielectric structure that has: a first dielectric portion, FDP, having a proximal end and a distal end, and a three-dimensional, 3D, shape having a direction of protuberance from the proximal end to the distal end oriented parallel with an effective z-axis of an orthogonal x, y, z coordinate system, the FDP comprising a dielectric material other than air; and a second dielectric portion, SDP, having a proximal end and a distal end, the proximal end of the SDP being disposed proximate the distal end of the FDP to form the dielectric structure, the SDP comprising a dielectric material other than air; wherein the SDP has a 3D shape having a first x-y plane cross-section area proximate the proximal end of the SDP, and a second x-y plane cross-section area between the proximal end and the distal end of the SDP, the second x-y plane cross section area being greater than the first x-y plane cross-section area.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Figure 1A:
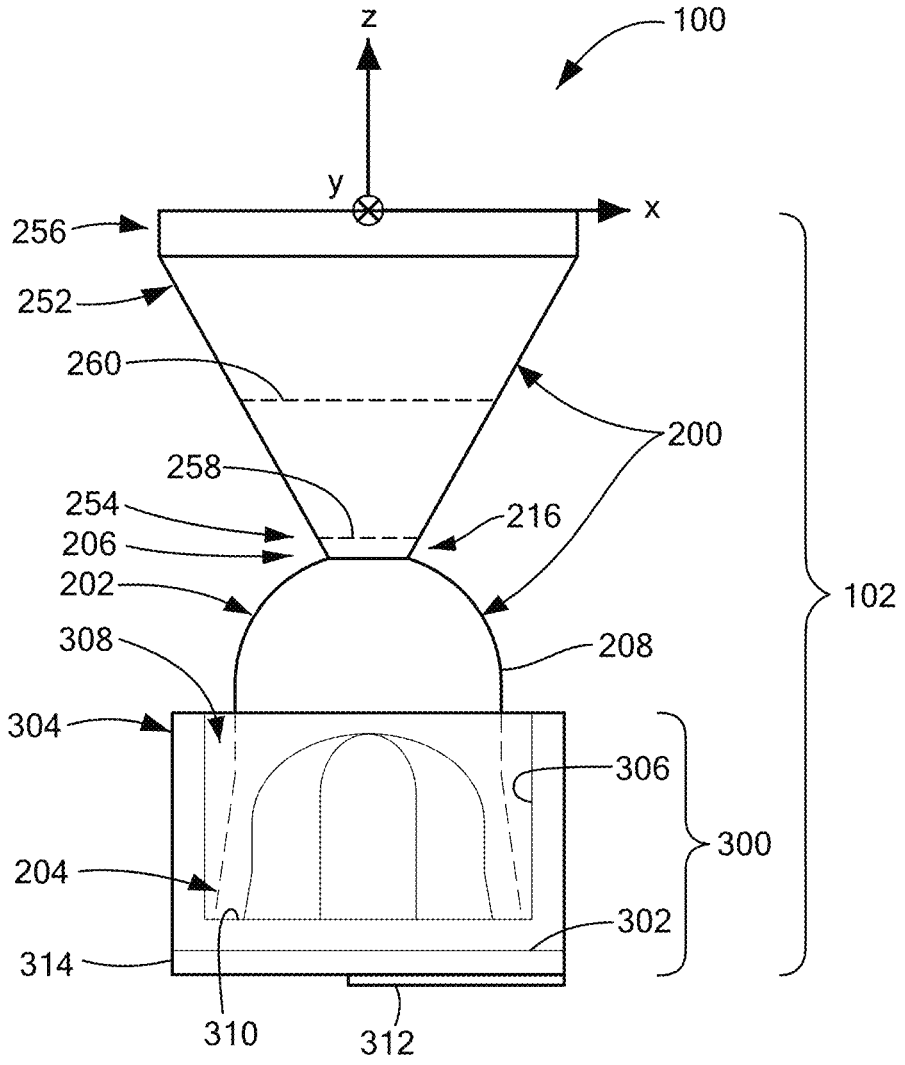
FIGS. 1A-1F depict side x-z plane central cross-section views of various electromagnetic, EM, devices having dielectric structures, first dielectric portions and second dielectric portions, that form unit cells, in accordance with an embodiment.

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

An embodiment, as shown and described by the various figures and accompanying text, provides an electromagnetic device in the form of a dielectric structure having a first dielectric portion and a second dielectric portion strategically disposed with respect to the first dielectric portion so as to provide for improved gain, improved bandwidth, improved return loss, and/or improved isolation, when at least the first dielectric portion is electromagnetically excited to radiate (e.g., electromagnetically resonate and radiate) an electromagnetic field in the far field. In an embodiment, only the first dielectric portion is electromagnetically excited to radiate an electromagnetic field in the far field. In another embodiment, both the first dielectric portion and the second dielectric portion are electromagnetically excited to radiate an electromagnetic field in the far field. In an embodiment where only the first dielectric portion is electromagnetically excited to radiate an electromagnetic field in the far field, the first dielectric portion may be viewed as an electromagnetic dielectric resonator, and the second dielectric portion may be viewed as a dielectric electromagnetic beam shaper. In an embodiment where both the first dielectric portion and the second dielectric portion are electromagnetically excited to radiate an electromagnetic field in the far field, the combination of the first dielectric portion and the second dielectric portion may be viewed as an electromagnetic dielectric resonator, and where the second dielectric portion may also be viewed as a dielectric electromagnetic beam shaper. In an embodiment, the dielectric structure is an all-dielectric structure (absent embedded metal or metal particles, for example).

In an embodiment where only the first dielectric portion is electromagnetically excited to radiate an electromagnetic field in the far field, the height of the first dielectric portion is selected such that greater than 50% of the resonant mode electromagnetic energy in the near field is present within the first dielectric portion for a selected operating free space wavelength associated with the dielectric structure. In an embodiment where both the first dielectric portion and the second dielectric portion are electromagnetically excited to radiate an electromagnetic field in the far field, the height of the first dielectric portion is selected such that some of the aforementioned greater than 50% of the resonant mode electromagnetic energy in the near field is also present within the second dielectric portion for a selected operating free space wavelength associated with the dielectric structure.

FIG. 1A depicts and electromagnetic, EM, device 100 having a dielectric structure 200 composed of a first dielectric portion 202 and a second dielectric portion 252. The first dielectric portion 202 has a proximal end 204 and a distal end 206, and a three-dimensional, 3D, shape 208 having a direction of protuberance from the proximal end 204 to the distal end 206 oriented parallel with a z-axis of an orthogonal x, y, z coordinate system. For purposes disclosed herein, the z-axis of the orthogonal x, y, z coordinate system is aligned with and is coincidental with a central vertical axis of an associated first dielectric portion 202, with the x-z, y-z and x-y planes being oriented as depicted in the various figures, and with the z-axis orthogonal to a substrate of the EM device 100. That said, it will be appreciated that a rotationally translated orthogonal x', y', z' coordinate system may be employed, where the z'-axis is not orthogonal to a substrate of the EM device 100. Any and all such orthogonal coordinate systems suitable for a purpose disclosed herein are contemplated and considered fall within the scope of an invention disclosed herein. The first dielectric portion 202 comprises a dielectric material that is other than air, but in an embodiment may include an internal region of air, vacuum, or other gas suitable for a purpose disclosed herein, when the first dielectric portion 202 is hollow. In an embodiment, the first dielectric portion 202 may comprise a layered arrangement of dielectric shells, with each successive outwardly disposed layer substantially embedding and being in direct contact with an adjacent inwardly disposed layer. The second dielectric portion 252 has a proximal end 254 and a distal end 256, with the proximal end 254 of the second dielectric portion 252 being disposed proximate the distal end 206 of the first dielectric portion 202 to form the dielectric structure 200. The second dielectric portion 252 comprises a dielectric material other than air. The second dielectric portion 252 has a 3D shape having a first x-y plane cross-section area 258 proximate the proximal end 254 of the second dielectric portion 252, and a second x-y plane cross-section area 260 between the proximal end 254 and the distal end 256 of the second dielectric portion 252, where the second x-y plane cross section area 260 is greater than the first x-y plane cross-section area 258. In an embodiment, the first x-y plane cross-section area 258 and the second x-y plane cross-section area 260 are circular, but in some other embodiments may be ovaloid, or any other shape suitable for a purpose disclosed herein. As depicted in FIG. 1A, the second dielectric portion 252 has a cross-section shape in the x-z plane that is conical. As can be seen in the EM device 100 of FIG. 1A, and other EM devices described further herein below with reference to FIGS. 1B-1F, the shape of the first dielectric portion 202 and the second dielectric portion 252 at the transition region of the two materials produces a neck 216 in the dielectric structure 200 that is void of any dielectric material of either the first dielectric portion 202 or the second dielectric portion 252. It is contemplated that this neck 216 is instrumental in increasing the directivity of the far field radiation pattern in a desirable manner.

In an embodiment, the second dielectric portion 252 is disposed in direct intimate contact with the first dielectric portion 202 absent an air gap therebetween, and may be at least partially embedded within the first dielectric portion 202 at the distal end 206 of the first dielectric portion 202.

In another embodiment, the proximal end of the second dielectric portion 252 is disposed at a distance away from the distal end of the first dielectric portion 202 by a distance of less the 5 times, or less the 4 times, or less than 3 times, or less than 2 times, or less than 1 times, or less than 0.5 times, the free space wavelength of an emitted (center frequency) radiation of the dielectric structure 200.

With reference to the foregoing description of FIG. 1A in combination with FIGS. 1B-1F, where like elements are numbered alike, it will be appreciated that the second dielectric portion 252 may have any cross-section shape suitable for a purpose disclosed herein. For example: in FIG. 1B, second dielectric portion 252 has a cross-section shape in the x-z plane that is parabolic, where the vertex of the parabolic-shaped second dielectric portion 252 is at the proximal end 254 of the second dielectric portion 252; in FIG. 1C, the second dielectric portion 252 has a cross-section shape in the x-z plane that is horn-shaped; in FIG. 1D, the second dielectric portion 252 has a cross-section shape in the x-z plane that is circular; in FIG. 1E, the second dielectric portion 252 has a cross-section shape in the x-z plane that is ovaloid; and in FIG. 1F, the second dielectric portion 252 has a cross-section shape in the x-z plane that mirrors the x-z plane cross-section shape of the first dielectric portion 202.

In an embodiment, any of the second dielectric portions 252 as depicted in FIGS. 1A-1F may have a cross-section shape in the y-z plane that is the same as its cross-section shape in the x-z plane. However, in the case of an ovaloid shaped second dielectric portion 252 in the x-z plane (see FIG. 1E), the second dielectric portion 252 may have a cross-section shape in the y-z plane that is circular.

Figure 1C:
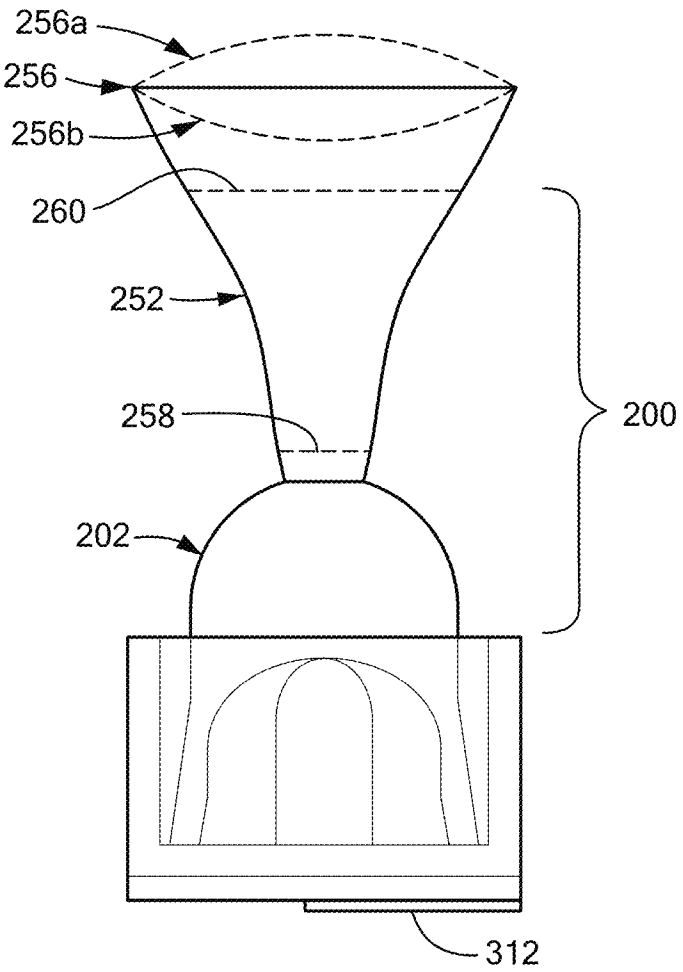
Figure 1B:
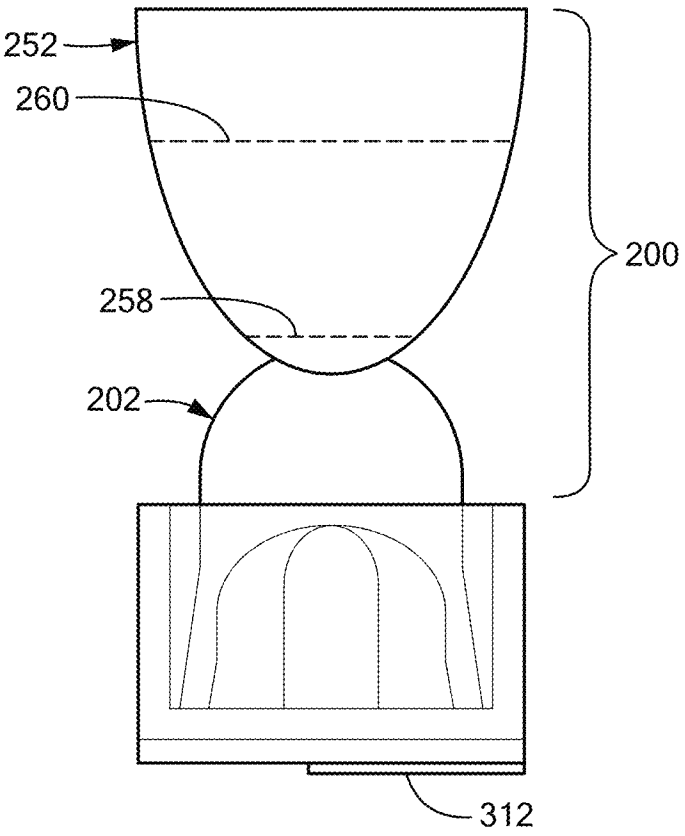

With reference to FIGS. 1A-1C and 1F, and specifically to FIG. 1C, an embodiment includes a second dielectric portion 252 having a flat distal end 256. However, and as depicted in FIG. 1C via dashed lines, an embodiment also includes a second dielectric portion 252 that may have a convex distal end 256*a*, or a concave distal end 256*b*.

While FIGS. 1A-1F depict second dielectric portions 252 being symmetrical with respect to the z-axis, it will be appreciated that these are non-limiting illustrations, and that the scope of the invention is not so limited. For example, FIG. 2A depicts an example arrangement of a 2×2 array of dielectric structures 200 (only the front two dielectric structures being visible, the back two dielectric structures being disposed directly behind the front two dielectric structures), having individual constructions similar to that of FIG. 1A with the second dielectric portions 252 being symmetrical with respect to the z-axis. FIGS. 2B and 2C depict similar arrangements to that of FIG. 2A, but with alternative second dielectric portions 252 having an asymmetrical cross-section shape in the x-z plane, relative to a plane of reflection of an emitted radiation associated with the device, which serves to further control the directionality of the electromagnetic radiation from the dielectric structures. FIG. 2C depicts more asymmetry than FIG. 2B to illustrate that any degree of asymmetry may be employed for a purpose disclosed herein, which is herein contemplated.

FIGS. 2A-2C also illustrate embodiments where the second dielectric portions 252 of a plurality of dielectric structures 200 (e.g., in an array) are connected by a connecting structure 262 (discussed further below).

In an embodiment, the dielectric material of the second dielectric portion 252 has an average dielectric constant that is less than the average dielectric constant of the dielectric material of the first dielectric portion 202. In another embodiment, the dielectric material of the second dielectric portion 252 has an average dielectric constant that is greater than the average dielectric constant of the dielectric material of the first dielectric portion 202. In a further embodiment, the dielectric material of the second dielectric portion 252 has an average dielectric constant that is equal to the average dielectric constant of the dielectric material of the first dielectric portion 202. In an embodiment, a dielectric material of the first dielectric portion 202 has an average dielectric constant of greater than 3, and the dielectric material of the second dielectric portion 252 has an average dielectric constant of equal to or less than 3. In an embodiment, the dielectric material of the first dielectric portion 202 has an average dielectric constant of greater than 5, and the dielectric material of the second dielectric portion 252 has an average dielectric constant of equal to or less than 5. In an embodiment, the dielectric material of the first dielectric portion 202 has an average dielectric constant of greater than 10, and the dielectric material of the second dielectric portion 252 has an average dielectric constant of equal to or less than 10. In an embodiment, the dielectric material of the second dielectric portion 252 has an average dielectric constant that is greater than the dielectric constant of air.

With reference now back to FIG. 1A, an embodiment of the EM device 100 further includes an electromagnetically reflective structure 300 having an electrically conductive structure 302, such as a ground structure for example, and at least one electrically conductive electromagnetic reflector 304 that may be integrally formed with and/or is in electrical communication with the electrically conductive structure 302. As used herein, the phrase integrally formed means a structure formed with material common to the rest of the structure absent material discontinuities from one region of the structure to another, such as a structure produced from a plastic molding process, a 3D printing process, a deposition process, or a machined or forged metal-working process, for example. Alternatively, integrally formed means a unitary one-piece indivisible structure. Each of the at least one electrically conductive electromagnetic reflector forms a wall 306 that defines and at least partially circumscribes a recess 308 having an electrically conductive base 310 that forms part of or is in electrical communication with the electrically conductive structure 302. A respective one of the dielectric structure 200 is disposed within a given one of the recess 308 and is disposed on the respective electrically conductive base 310. An embodiment of the EM device includes a signal feed 312 for electromagnetically exciting a given dielectric structure 200, where the signal feed 312 is separated from the electrically conductive structure 302 via a dielectric 314, and where in an embodiment the signal feed 312 is a microstrip with slotted aperture. However, excitation of a given dielectric structure 200 may be provided by any signal feed suitable for a purpose disclosed herein, such as a copper wire, a coaxial cable, a microstrip (e.g., with slotted aperture), a stripline (e.g., with slotted aperture), a waveguide, a surface integrated waveguide, a substrate integrated waveguide, or a conductive ink, for example, that is electromagnetically coupled to the respective dielectric structure 200. As will be appreciated by one skilled in the art, the phrase electromagnetically coupled is a term of art that refers to an intentional transfer of electromagnetic energy from one location to another without necessarily involving physical contact between the two locations, and in reference to an embodiment disclosed herein more particularly refers to an interaction between a signal source having an electromagnetic resonant frequency that coincides with an electromagnetic resonant mode of the associated dielectric structure 200. A single one of the combination of a dielectric structure 200 and an electromagnetically reflective structure 300, as depicted in FIG. 1A for example, is herein referred to as a unit cell 102.

Figure 3A:
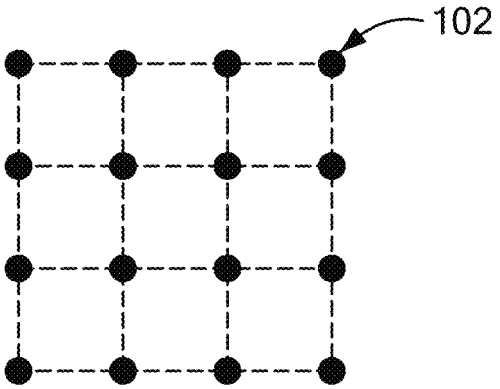
FIGS. 3A-3G depict a schematic representation of a variety of formations for an array of a plurality of EM devices having dielectric structures, in accordance with an embodiment.
Figure 3B:
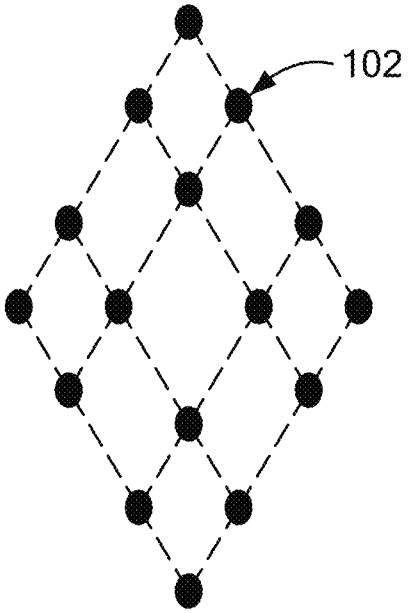
Figure 3C:
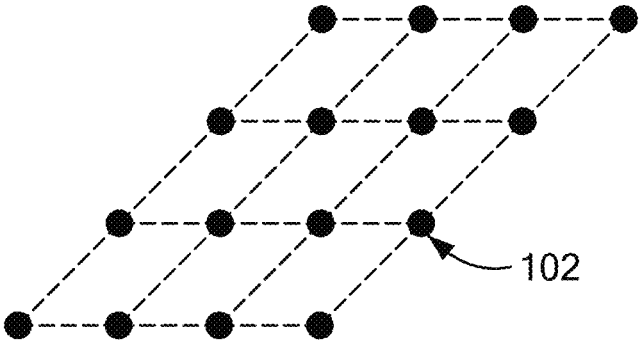
Figure 3D:
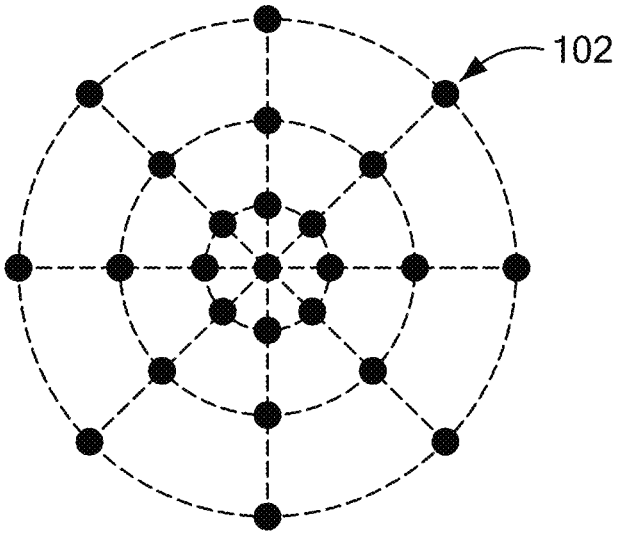
Figure 3E:
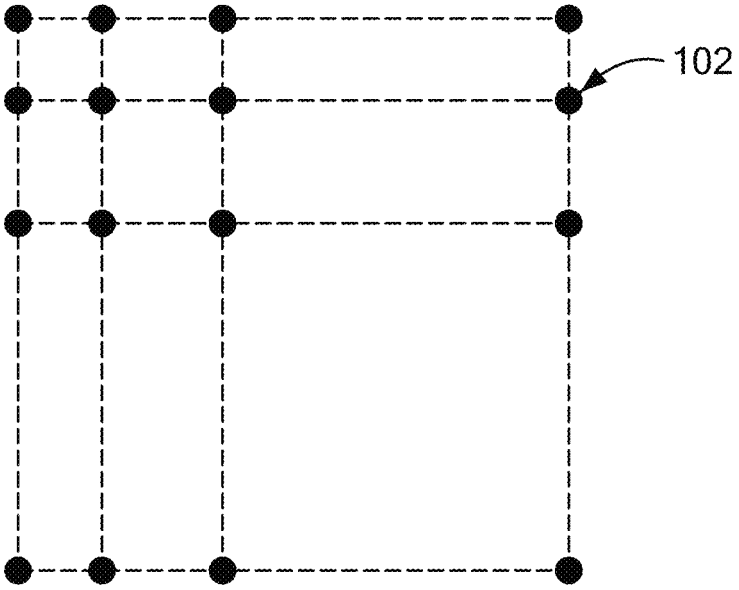
Figure 3F:
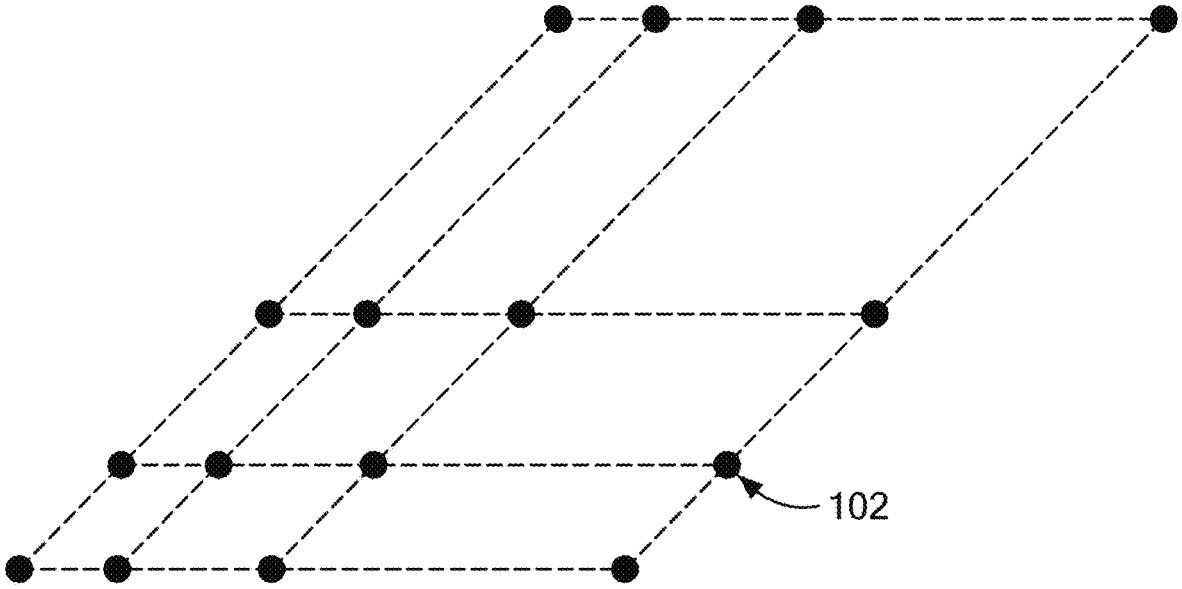
Figure 3G:
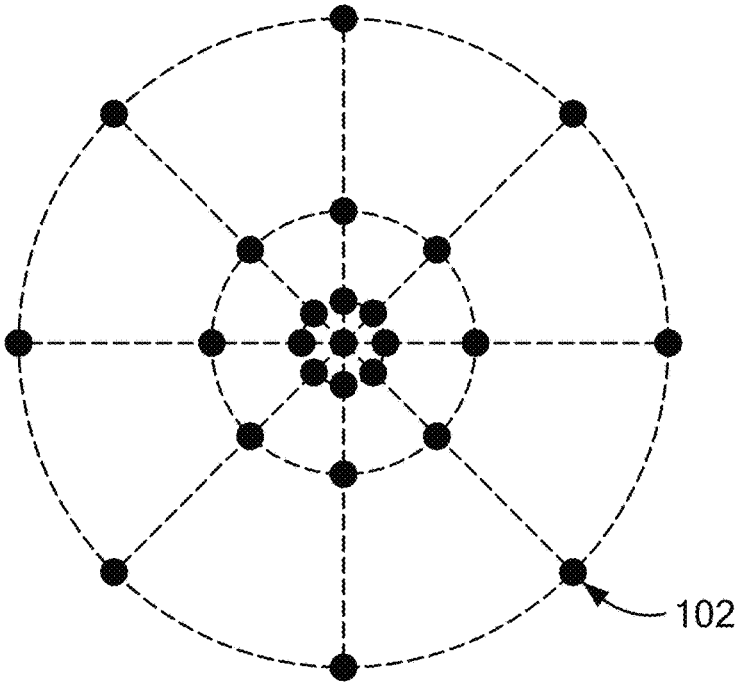

As noted herein above with reference to FIGS. 2A-2C, an embodiment includes an array of unit cells 102 having one of a plurality of dielectric structures 200 disposed in one-to-one relationship with a respective one of a plurality of electromagnetically reflective structures 300, forming an array of a plurality of EM devices 100 having dielectric structures 200. With reference now to FIGS. 3A-3F, it will be appreciated that the array of EM devices may have any number of EM devices in any arrangement suitable for a purpose disclosed herein. For example, the array of EM devices having dielectric structures may have anywhere from two to ten thousand or more dielectric structures, and may be arranged with a center-to-center spacing between neighboring dielectric structures in accordance with any of the following arrangements:

equally spaced apart relative to each other in an x-y grid formation, see FIG. 3A for example;

spaced apart relative to each other in a diamond formation, see FIG. 3B for example;

spaced apart relative to each other on an oblique grid in a uniform periodic pattern, see FIG. 3C for example;

spaced apart relative to each other on a radial grid in a uniform periodic pattern, see FIG. 3D for example;

spaced apart relative to each other on an x-y grid in an increasing or decreasing non-periodic pattern, see FIG. 3E for example;

spaced apart relative to each other on an oblique grid in an increasing or decreasing non-periodic pattern, see FIG. 3F for example;

spaced apart relative to each other on a radial grid in an increasing or decreasing non-periodic pattern, see FIG. 3G for example;

spaced apart relative to each other in a uniform periodic pattern, see FIGS. 3A, 3B, 3C, 3D for example;

spaced apart relative to each other in an increasing or decreasing non-periodic pattern, see FIGS. 3E, 3F, 3G for example;

spaced apart relative to each other on a non-x-y grid in a uniform periodic pattern, see FIG. 3D for example; or spaced apart relative to each other on a non-x-y grid in an increasing or decreasing non-periodic pattern, see FIG. 3G for example.

Figures 1D, 1E, 1F:
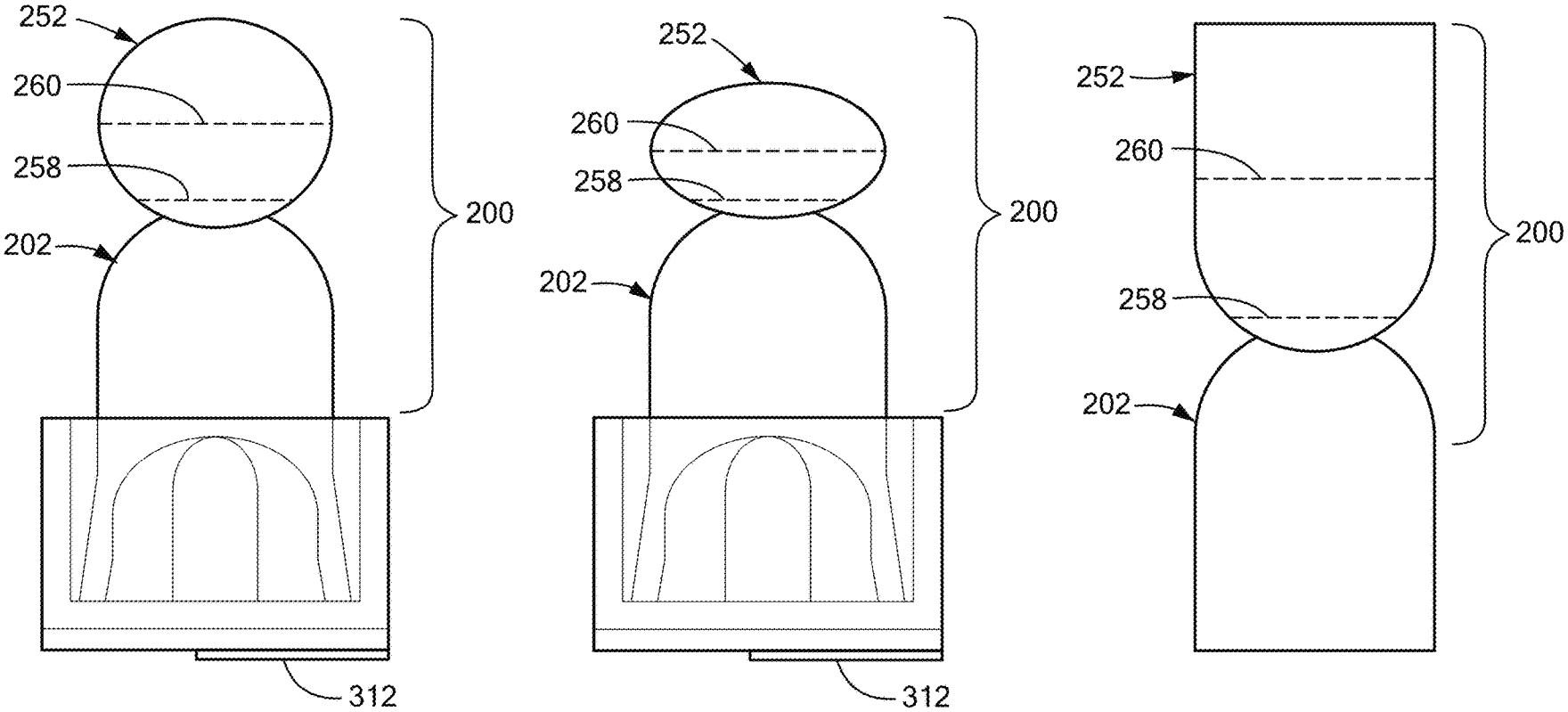
Figure 2A:
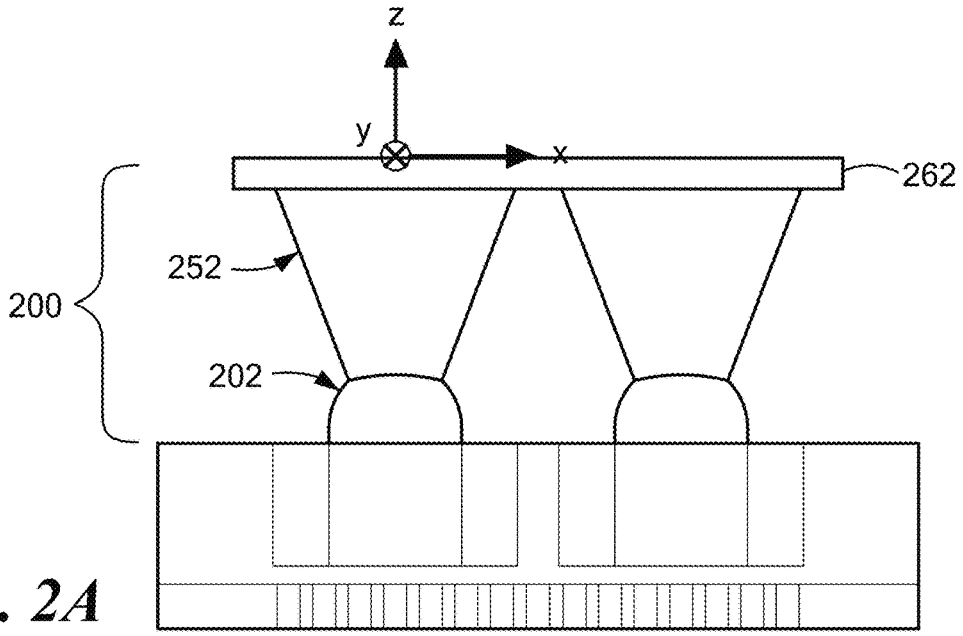
FIGS. 2A-2C depict side x-z plane central cross-section views of example arrangements of dielectric structures having symmetrical and asymmetrical second dielectric portions with respect to the z-axis, in accordance with an embodiment.
Figure 2B:
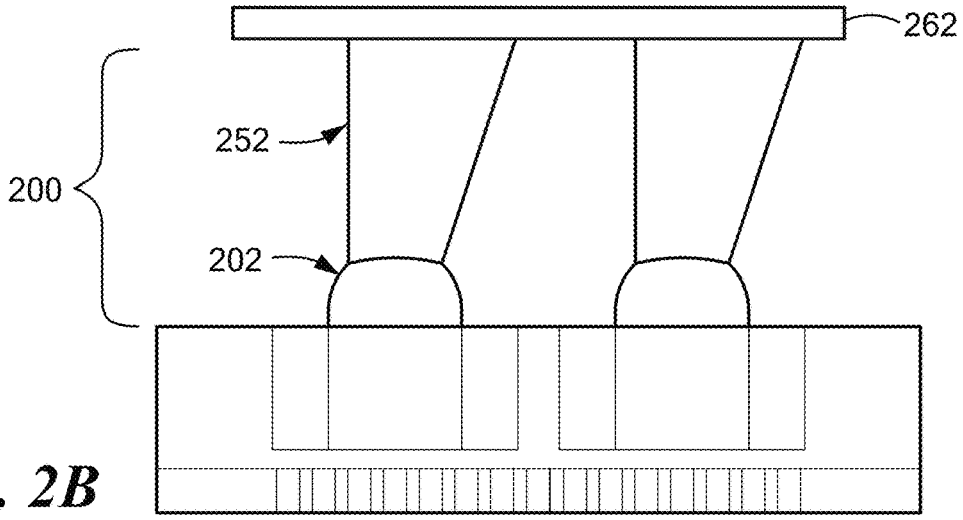
Figure 2C:
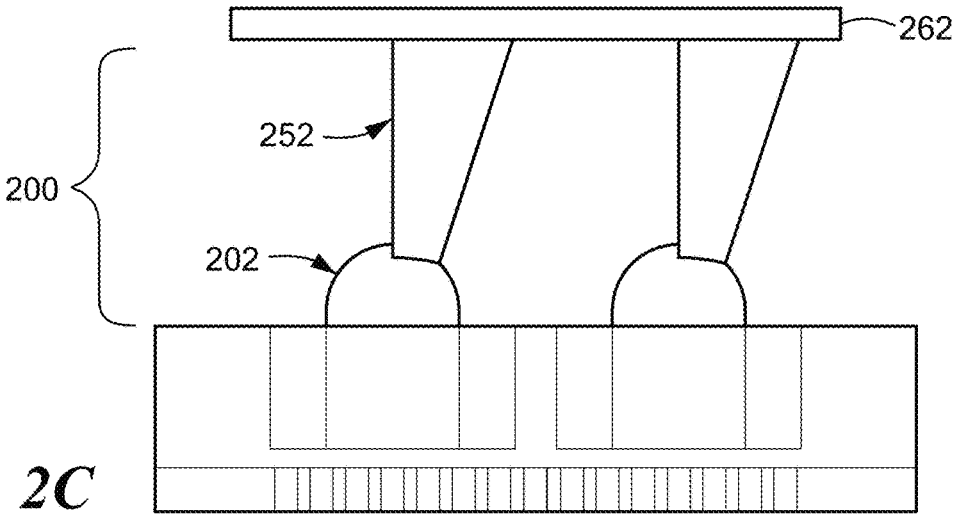
Figure 4A:
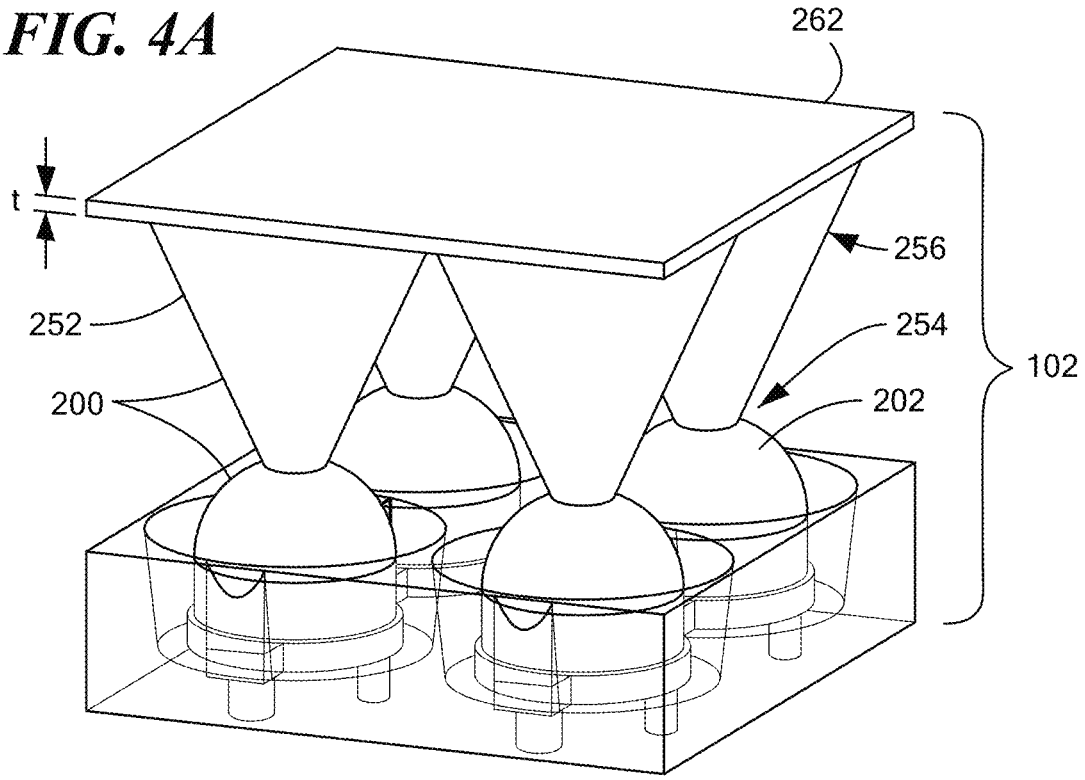
FIGS. 4A and 4B depict rotated isometric views of two-by-two arrays of unit cells having conical and spherical second dielectric portions, respectively, in accordance with an embodiment.
Figure 4B:
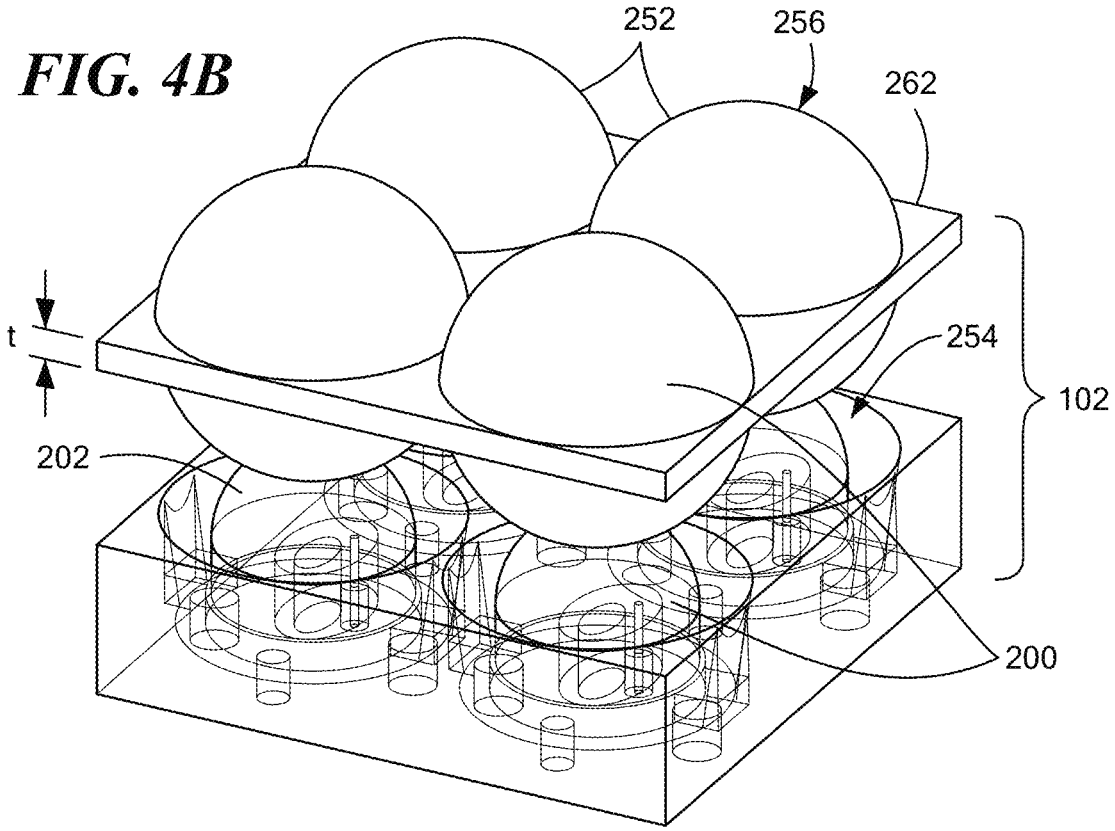

Reference is now made to FIGS. 4A and 4B, which depict two-by-two arrays of the unit cells 102 as depicted in FIGS. 1A and 1D, respectively, but with neighboring second dielectric portions 252 of each array of dielectric structures 200 (200 in FIG. 4A, and 200 in FIG. 4B) being connected via respective ones of a relatively thin dielectric connecting structure 262 relative to an overall dimension of the respective connected second dielectric portion 252. As depicted in FIG. 4A, a maximum overall cross-section dimension of the second dielectric structure 252 in the x-z plane is located at the distal end 256 of the conical shaped second dielectric structure 252, while as depicted in FIG. 4B, a maximum overall cross-section dimension of the second dielectric structure 252 in the x-z plane is located at an intermediate position between the proximal end 254 and the distal end 256 (the midpoint for example) of the spherical shaped second dielectric structure 252. In an embodiment, the thickness "t" of a respective one of the relatively thin connecting structure 262 is equal to or less that $\lambda/4$ of an associated operating frequency of the EM device 100, where $\lambda$, is the associated wavelength of the operating frequency measured in free space.

Figure 5:
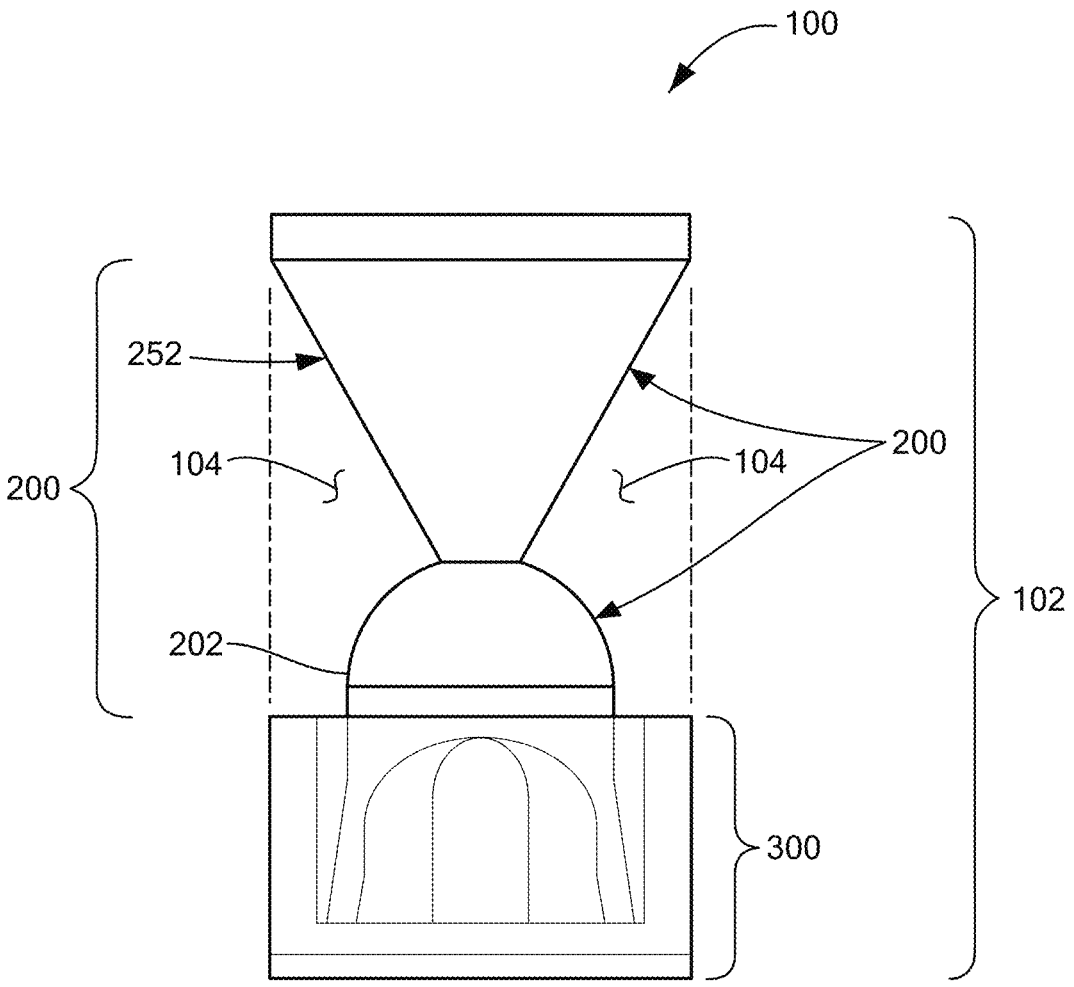
FIG. 5 depicts an EM device similar to that of FIG. 1A, but with the voids between adjacent ones of the dielectric structures forming an array of dielectric structures, comprising a non-gaseous dielectric material, in accordance with an embodiment.

Reference is now made to FIG. 5, which depicts an EM device 100 similar to that of FIG. 1A, which is also herein referred to as one unit cell 102 of an array of unit cells of dielectric structures 200. The unit cell 102 of FIG. 5 differs from the unit cell 102 of FIG. 1A, in that the voids 104 between adjacent ones of the dielectric structures 200 forming an array of dielectric structures comprise a non-gaseous dielectric material, which is contemplated to increase the rigidity of an array of dielectric structures for improved resistance to vibrational movement when an array of dielectric structures as disclosed herein are applied in an application involving movement of a vehicle, such as a radar system on an automobile for example, without substantially negatively impacting the operational performance of the array of dielectric structures. In an embodiment, the non-gaseous dielectric material in the voids 104 has a dielectric constant that is equal to or greater than air and equal to or less than the dielectric constant of an associated second dielectric portion 252 of the dielectric structures 200.

Figure 6:
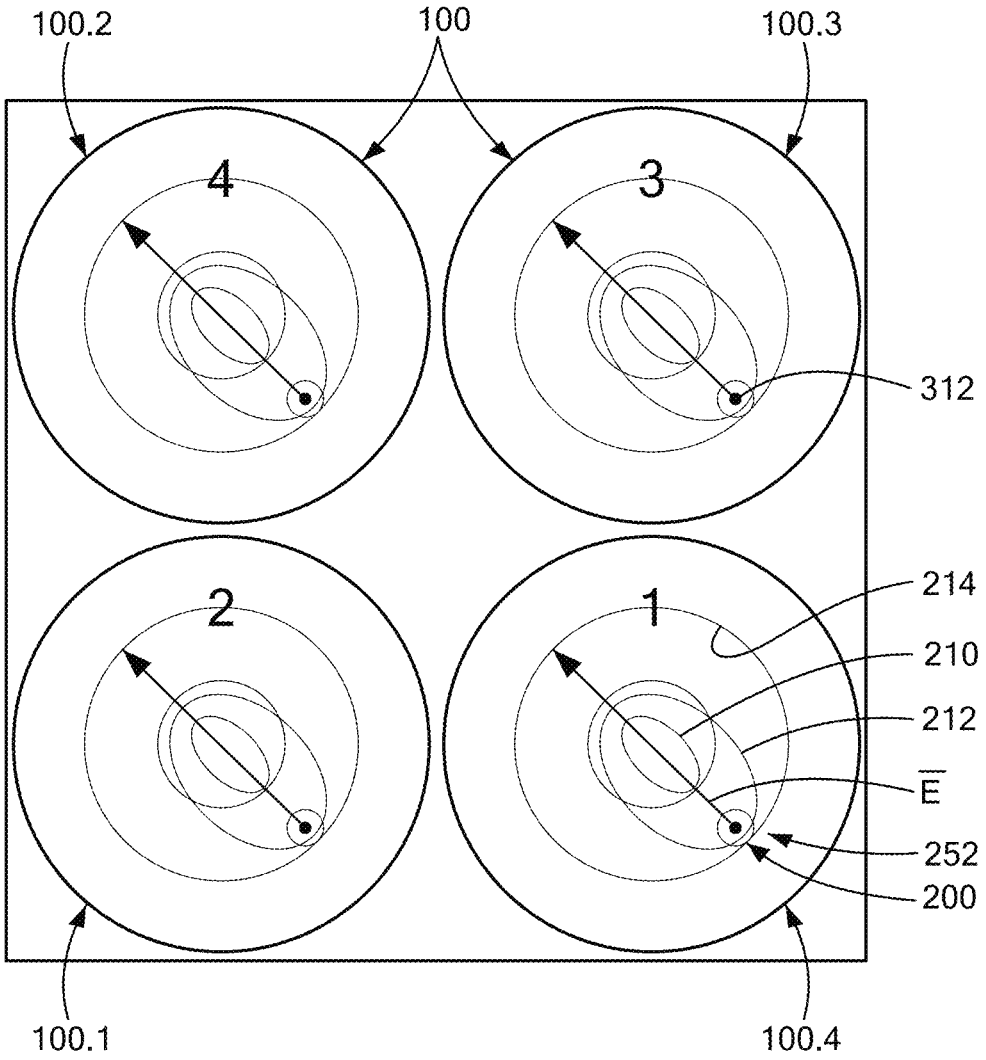
FIG. 6 depicts a two-by-two array of EM devices similar to that of FIGS. 1D and 4B, but with a signal feed structure configured to produce diagonal excitation, in accordance with an embodiment.
Figure 6:
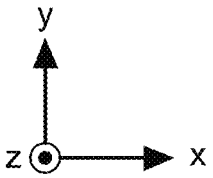

Reference is now made to FIG. 6, which depicts a two-by-two array of EM devices 100 similar to that depicted in FIGS. 1D and 4B (e.g., a dielectric structure 200 having spherical shaped second dielectric portion 252 disposed on top of the first dielectric portion 202 having a dome-shaped top), with corresponding signal ports 1-4 of the array denoted. Similar to FIG. 1D, each EM device 100 of FIG. 6 has a signal feed 312, but in the form of a coaxial cable embedded within the first dielectric portion 202, as opposed to a stripline or micro-strip or waveguide with slotted aperture. More specifically, the first dielectric portion 202 of FIG. 6 has a first inner volume of dielectric material 210 having a cross-section oval-like shape in the x-y plane, a second intermediate volume of dielectric material 212 having a cross-section oval-like shape in the x-y plane, and a third outer volume of dielectric material 214 having a cross-section circular shape in the x-y plane, where the third volume 214 substantially embeds the second volume 212, and the second volume 212 substantially embeds the first volume 210. In an embodiment, the first volume of dielectric material 210 is air, the second volume of dielectric material 212 has a dielectric constant that is greater than the dielectric constant of the first volume of dielectric material 210 and greater than the dielectric constant of the third volume of dielectric material 214, and the coaxial cable signal feed 312 is embedded within the second volume 212. Each spherical shaped second dielectric portion 252 is at least partially embedded in the associated first dielectric portion 202 having a dome-shaped top (see FIG. 1D), which produces a circular region of intersection as illustrated by the circular detail 106 in FIG. 6. As depicted in FIG. 6, the major axes of the oval-liked shaped first and second volumes of dielectric materials 210, 212 are aligned with each other and pass through the coaxial cable signal feed 312, which serves to radiate an E-field having an E-field direction line, $\bar{E}$, as depicted in FIG. 6. As also depicted in FIG. 6, the major axis of the second volume 212 is lengthwise shifted with respect to the $\bar{E}$ direction line, so that the second volume 212 embeds both the first volume 210 and the coaxial cable signal feed 312, and the circular third volume 214 is asymmetrically offset with respect to at least the second volume 212 to provide a portion of the third volume 214 diametrically opposing the coaxial cable signal feed 312 that is configured for receiving the radiated E-field along the $\bar{E}$ direction line. As depicted in FIG. 6, closest adjacent neighboring $\bar{E}$ direction lines are parallel with each other, a first pair of closest diagonal neighboring $\bar{E}$ direction lines are parallel with each other (see EM devices 100.1 and 100.3 for example), and a second pair of closest diagonal neighboring $\bar{E}$ directions lines are aligned with each other (see EM devices 100.2 and 100.4 for example). The structure of the array of FIG. 6 that produces the $\bar{E}$ direction lines as depicted in FIG. 6 is herein referred to as diagonal excitation.

The performance characteristics of several of the embodiments described herein above will now be described with reference to FIGS. 7-12.

Figure 7A:
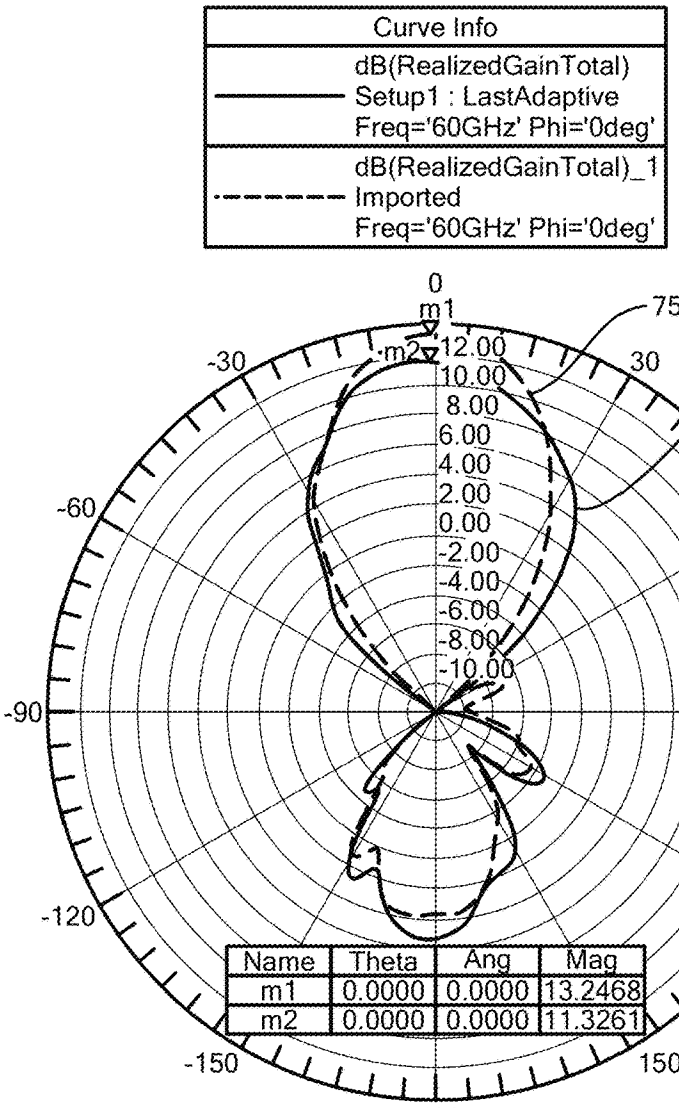
FIGS. 7A-12 depict performance characteristics of various embodiments disclosed herein, in accordance with an embodiment.
Figure 7B:
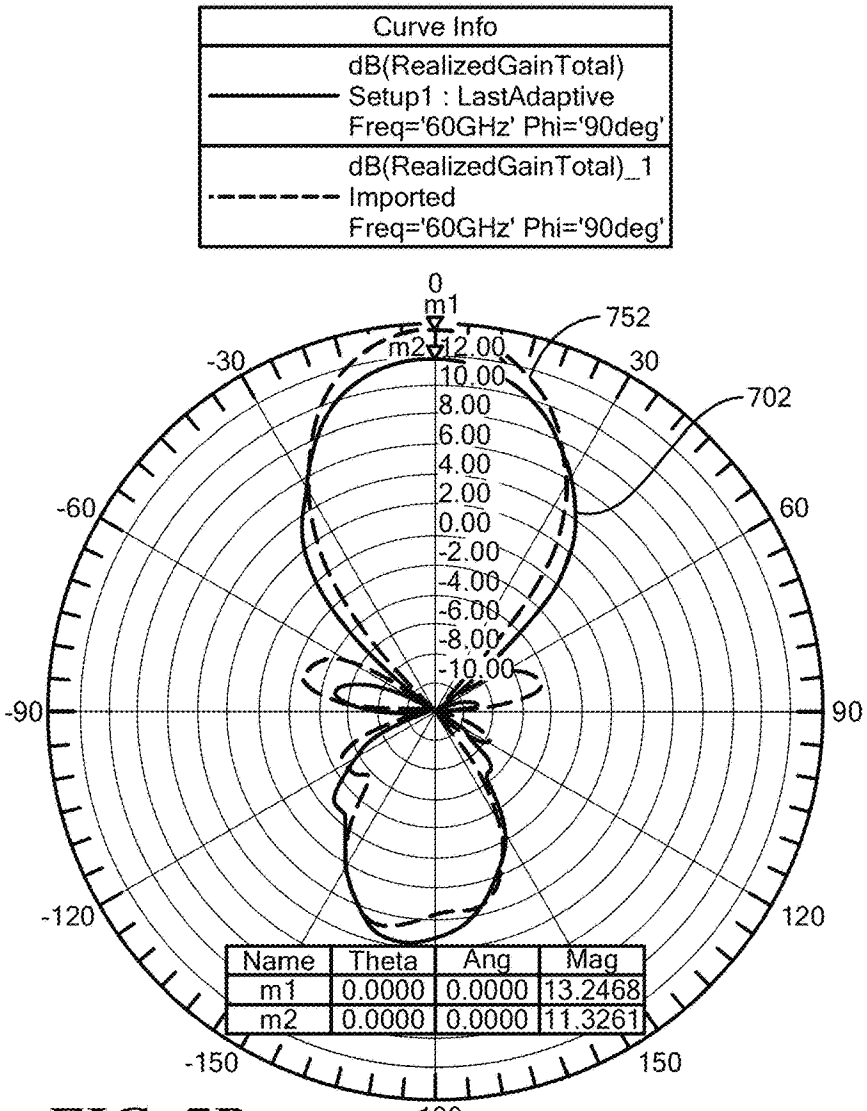

FIGS. 7A and 7B compare the simulated gains of a 2×2 array with an EM device 100 having a conical shaped near field second dielectric portion 252 (see FIGS. 1A and 4A for example) versus a similar 2×2 array of an EM device 100 but absent such a second dielectric portion. FIG. 7A depicts an azimuth plane radiation pattern with phi=0-degrees, and FIG. 7B depicts an elevation plane radiation pattern with phi=90-degrees. Curves 751 and 752 relate to the above noted array of EM devices 100 with the conical shaped second dielectric portion 252, and curves 701 and 702 relate to the above noted array of EM devices 100 absent such a second dielectric portion. As depicted in both FIGS. 7A and 7B, the gain of the EM device 100 is enhanced by about 2 dBi with the inclusion of a conical shaped second dielectric portion 252.

Figure 8:
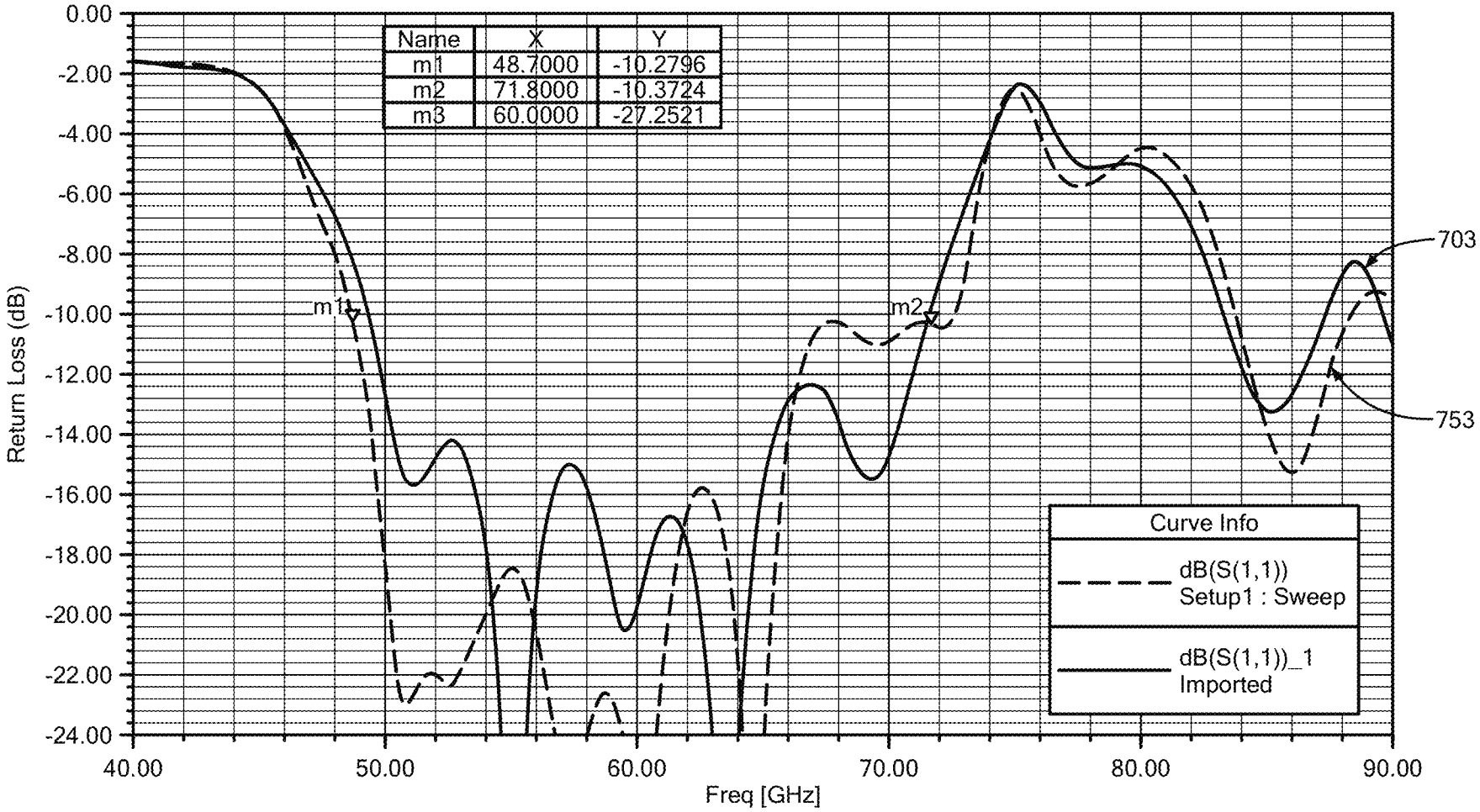

FIG. 8 depicts the simulated dBi return loss S(1, 1) for the above noted 2×2 array of the EM device 100 with and without the above noted conical shaped second dielectric portion 252. Curve 753 is representative of the return loss performance with the above noted conical shaped second dielectric portion 252, and curve 703 is representative of the return loss performance absent such a second dielectric portion. As can be seen by comparing the two curves 703, 753, the return loss performance shows general improvement with the conical shaped second dielectric portion 252 in the bandwidth of 50-65 GHz, with substantial improvement in the bandwidth of 56-65 GHz, as compared to the same EM device 100 but absent such a second dielectric portion.

Figure 9:
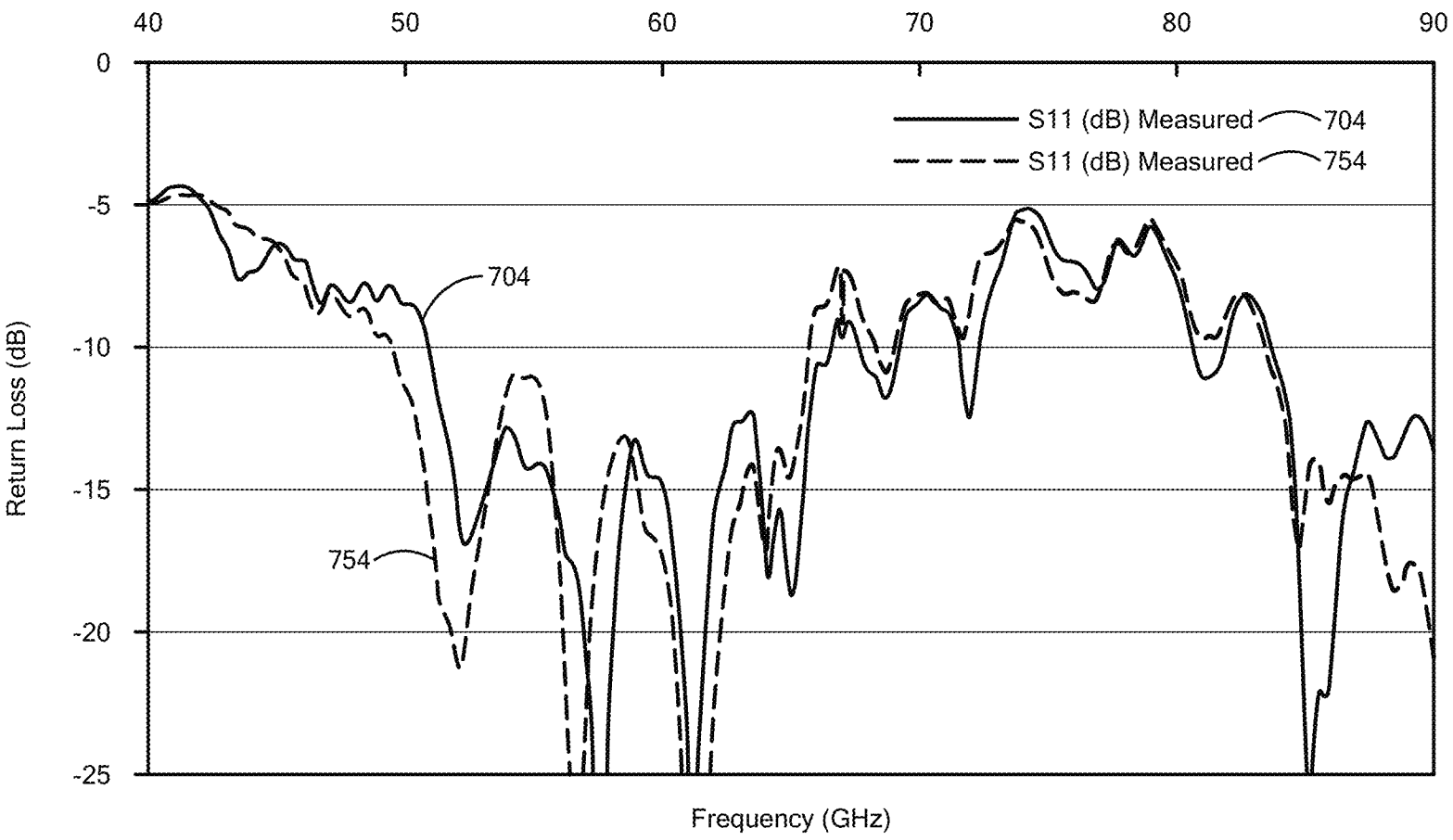

FIG. 9 depicts the measured dBi return loss S(1, 1) for prototype samples of the simulated arrays of FIG. 8, where curve 754 is representative of the measured return loss performance with the above noted conical shaped second dielectric portion 252, and curve 704 is representative of the measured return loss performance absent such a second dielectric portion. A comparison of FIGS. 8 and 9 shows that the measured return loss performance of prototype samples correlates closely with the simulated return loss performance.

Figure 10:
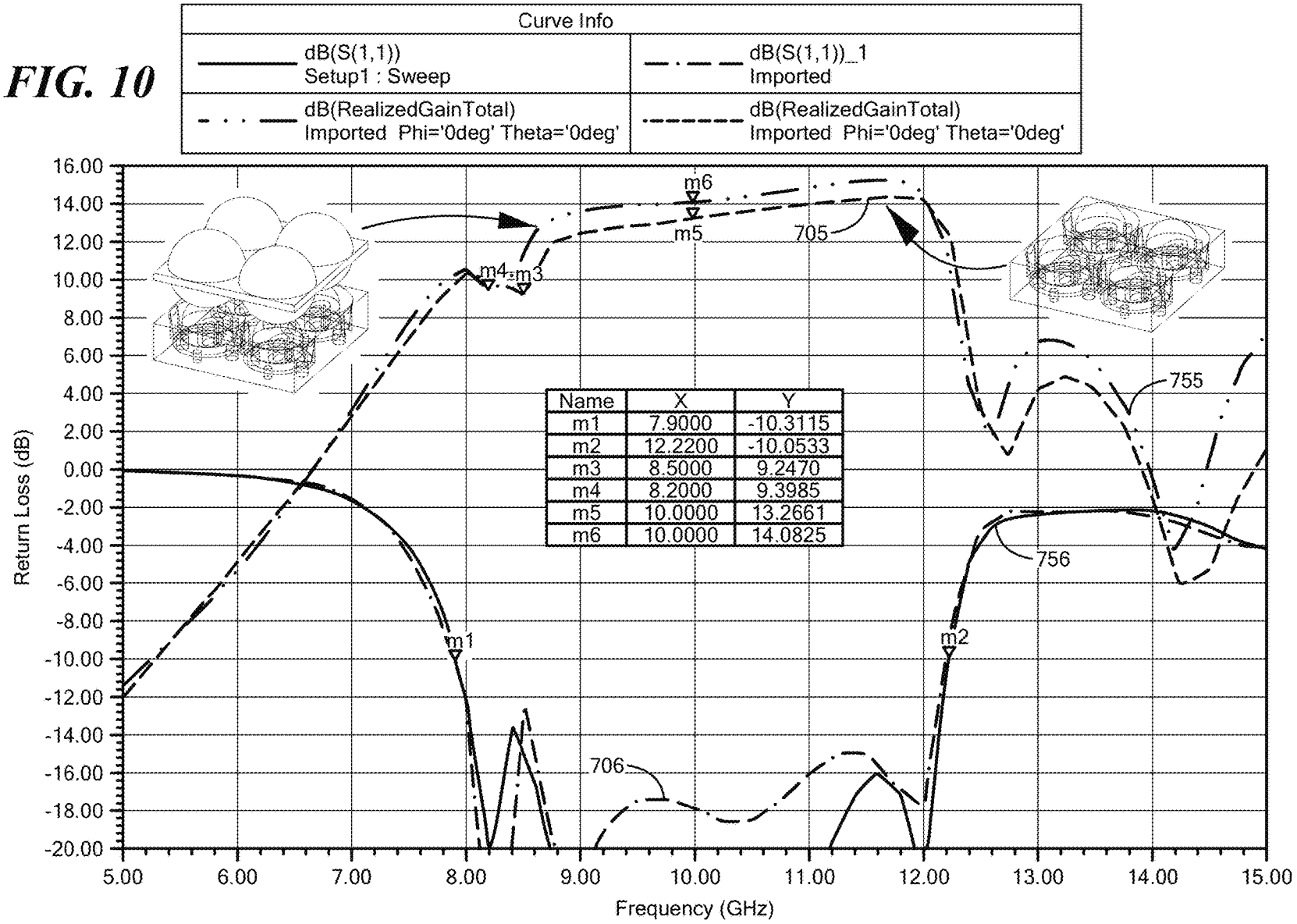
Figure 11A:
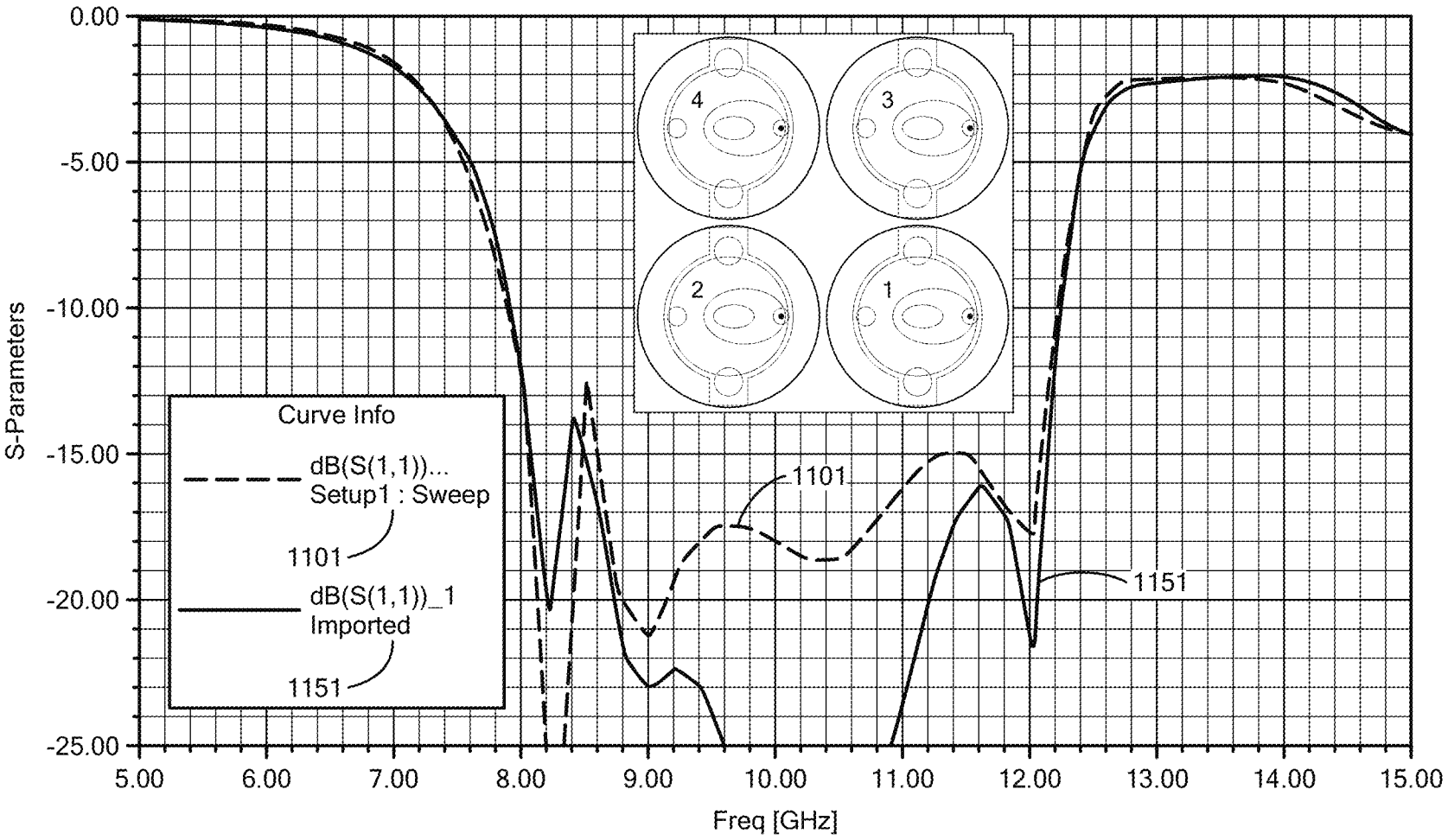
Figure 11B:
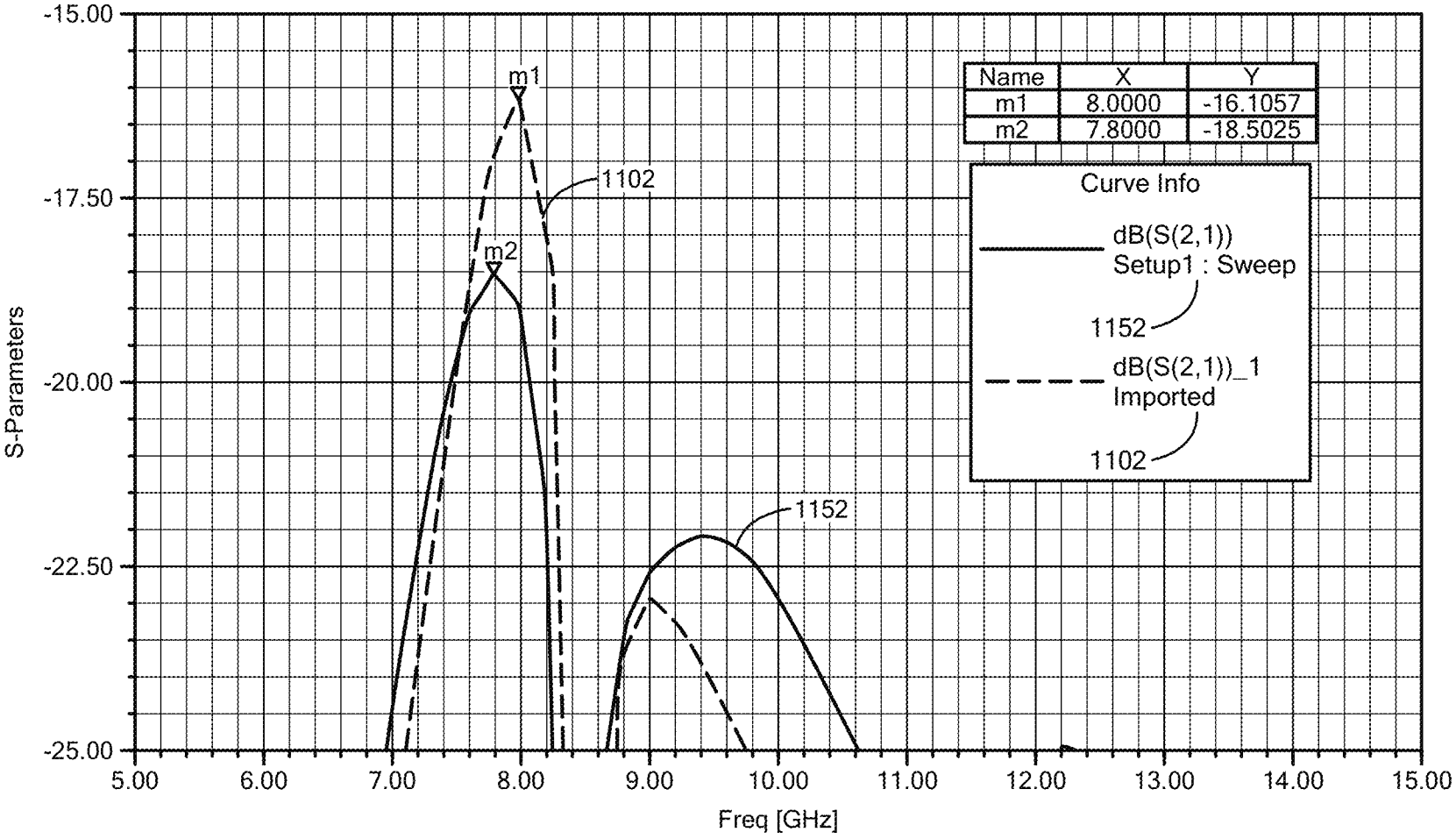
Figure 11C:
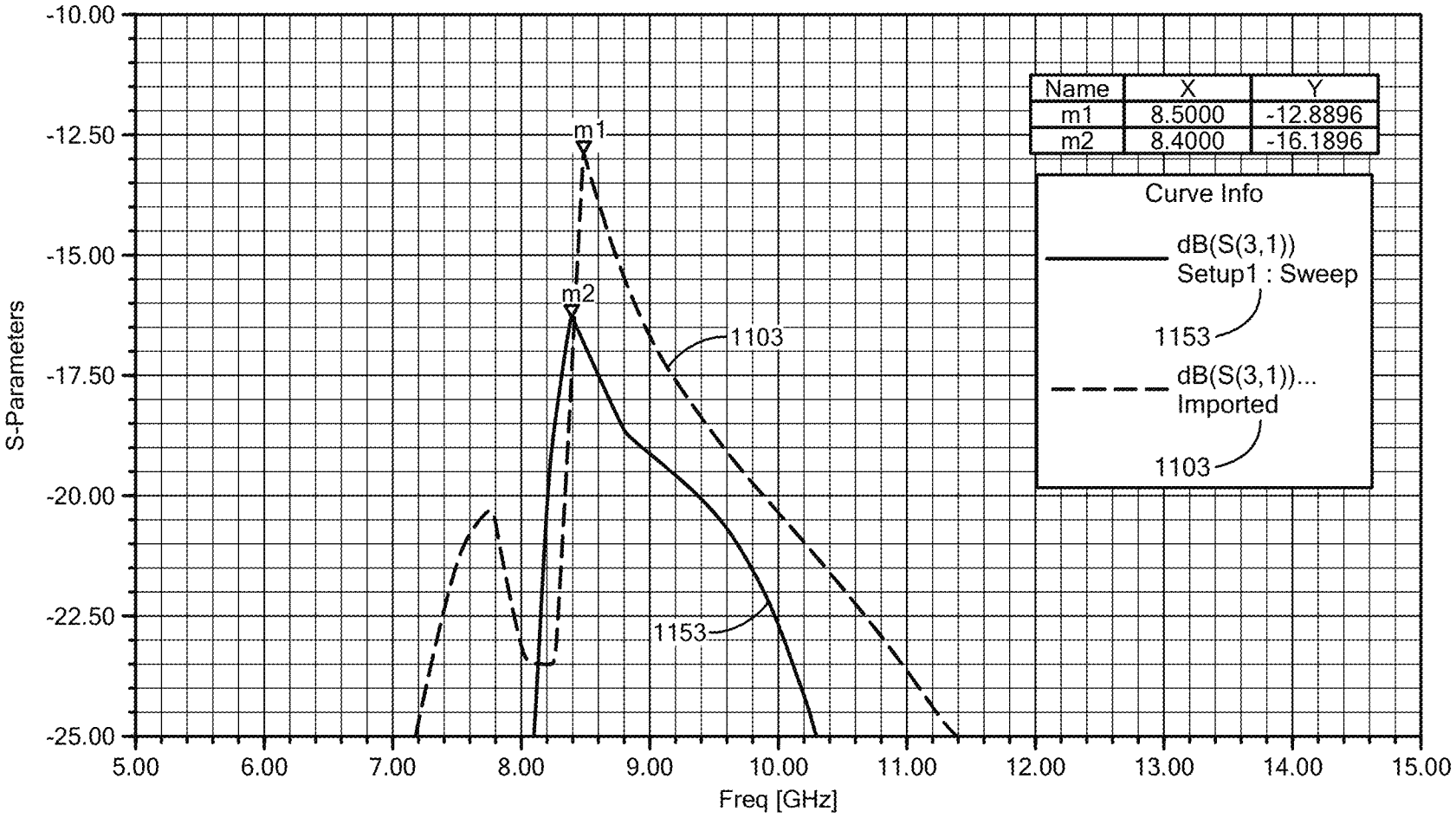
Figure 11D:
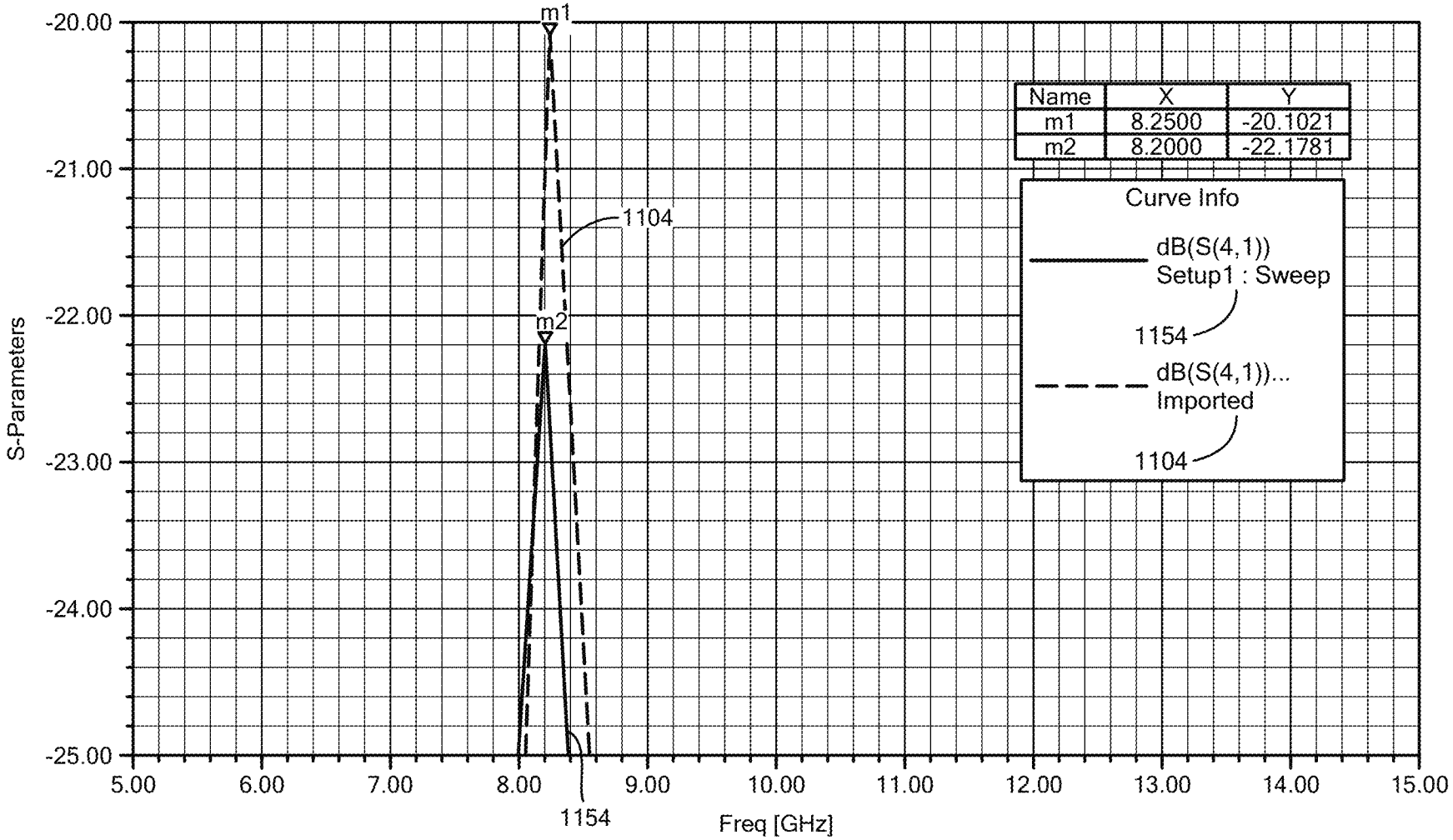

FIG. 10 compares the simulated gain and the simulated dBi return loss S(1, 1) performance of a 2×2 array with an EM device 100 having a spherical shaped near field second dielectric portion 252 (see FIGS. 1D and 4B for example) versus a similar 2×2 array of the EM device 100 but absent such a second dielectric portion. Curves 755 and 756 are representative of the gain and return loss performance, respectively, with the above noted spherical shaped second dielectric portion 252, and curves 705 and 706 are representative of the gain and return loss performance, respectively, absent such a second dielectric portion. As can be seen by comparing the two curves 705, 755 and the two curves 706, 756, a TM mode shift to the left occurs with the use of the above noted spherical shaped second dielectric portion 252, and the return loss performance shows improvement in the bandwidth of 8-12 GHz with the use of the above noted spherical shaped second dielectric portion 252, as compared to the same EM device absent such a second dielectric portion.

FIGS. 11A, 11B, 11C and 11D depict the denoted return loss S-parameters of a 2×2 array with an EM device 100 having a spherical shaped near field second dielectric portion 252 (see FIGS. 1D and 4B for example) versus a similar 2×2 array of the EM device 100 but absent such a second dielectric portion. The corresponding signal ports 1-4 of the array are denoted in FIG. 11A. Curves 1151, 1152, 1153 and 1154 are respectively representative of the S(1, 1), S(2, 1), S(3, 1) and S(4, 1) return losses with the above noted spherical shaped second dielectric portion 252, and curves 1101, 1102, 1103 and 1104 are respectively representative of the S(1, 1), S(2, 1), S(3, 1) and S(4, 1) return losses absent such a second dielectric portion. With reference to the m1 and m2 markers associated with the S(2, 1) return losses of curves 1102 and 1152, respectively, with the S(3, 1) return losses of curves 1103 and 1153, respectively, and with the S(4, 1) return losses of curves 1104, 1154, respectively, it can be seen that the spherical shaped second dielectric portion 252 improves the isolation between the nearest neighboring EM devices 100 by at least −2.4 dBi, −3.3 dBi, and −2.1 dBi, respectively.

Figure 12:
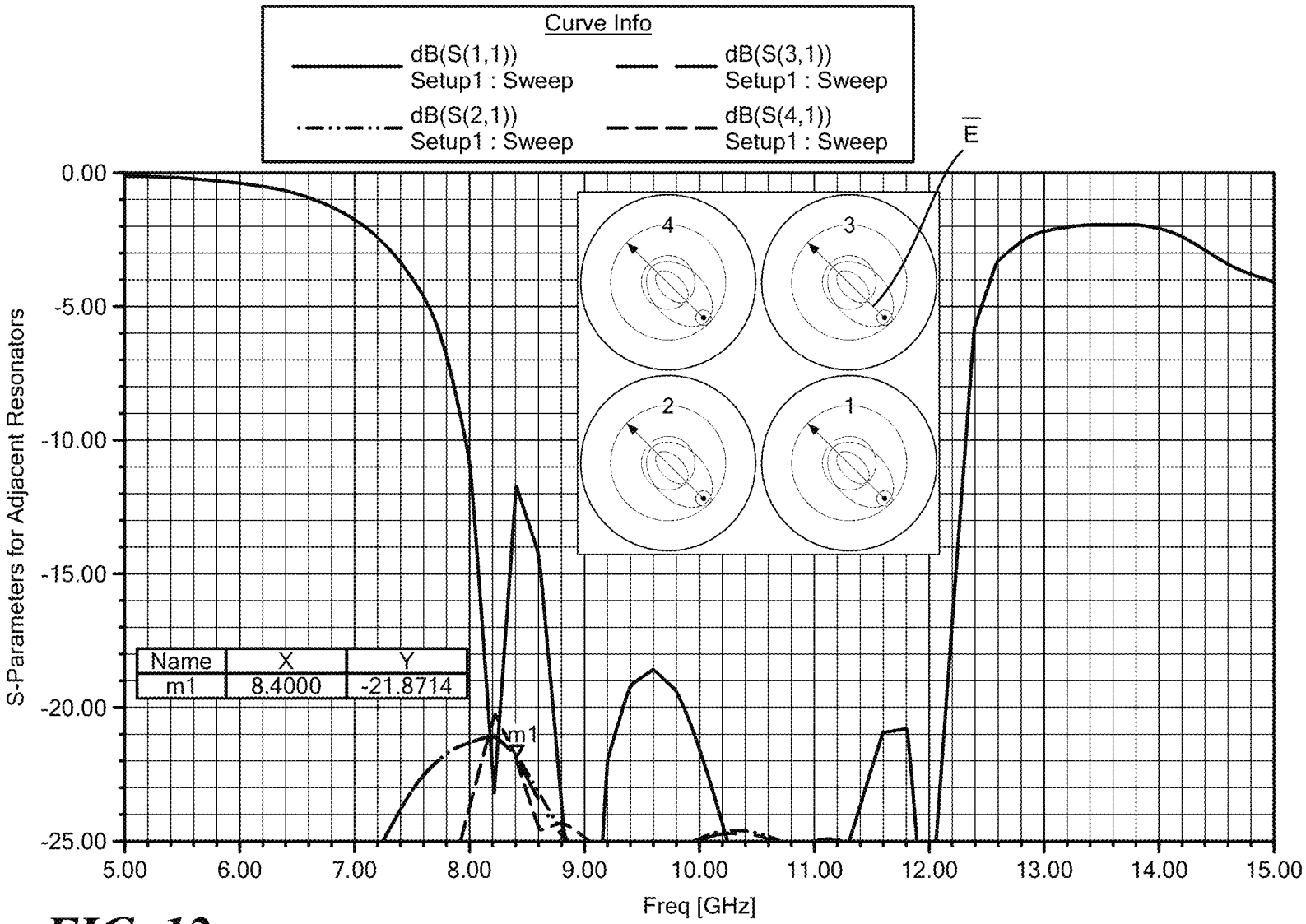

FIG. 12 depicts the return loss S-parameters of the 2×2 array of FIG. 6 having diagonal excitation, with corresponding signal ports 1-4 of the array denoted. With reference to the m1 marker that is associated with the S(3, 1) return loss, it can be seen that with diagonal excitation all interactions between nearest neighboring EM devices 100 having a spherical shaped second dielectric portion 252 are less than −20 dBi. A comparison of FIGS. 11 and 12 shows that a two-fold improvement in return loss is obtained, first by employing a near field second dielectric portion, and second by employing a diagonal excitation to the EM devices 100, as disclosed herein.

Reference is now made to FIGS. 13A-13E, which in general depict EM devices 100, more specifically dielectric structures 200 of the EM devices 100, having second dielectric portions 252 that are fully embedded within the associated first dielectric portions 202 such that the distal end 256 of the second dielectric portion 252 is the distal end of the dielectric structure 200. Similar to the EM device 100 of FIG. 1A, the EM devices 100 of FIGS. 13A-13E are also depicted having an electromagnetically reflective structure 300 with construction similar to that described herein above, where the dielectric structure 200 and an associated electromagnetically reflective structure 300 define a unit cell 102 having a defined cross-section overall outside dimension W in the x-z plane.

Figures 13A, 13B, 13C:
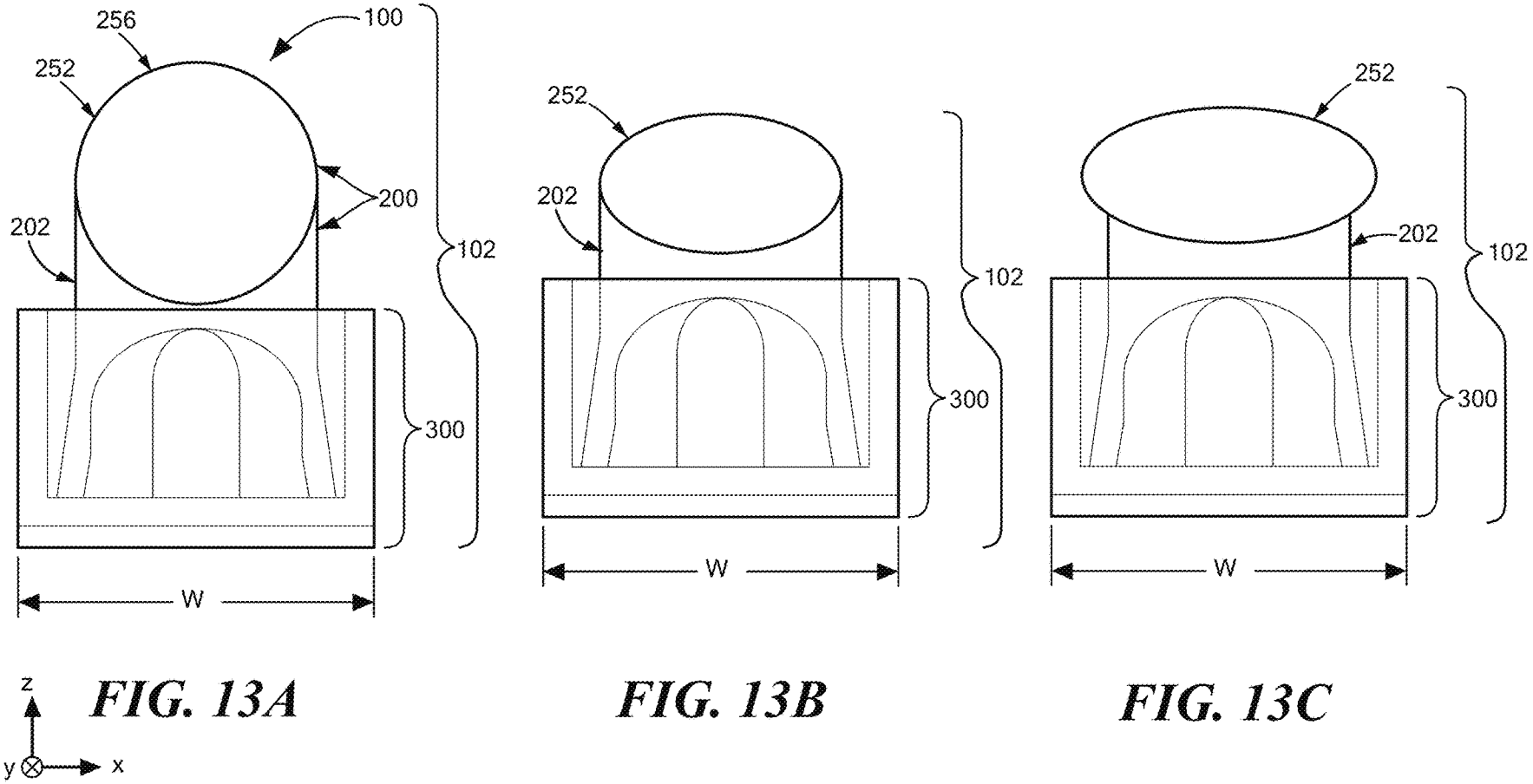
FIGS. 13A-13E depict several example embodiments of a second dielectric portion that is fully embedded with an associated first dielectric portion, in accordance with an embodiment.
Figure 13E:
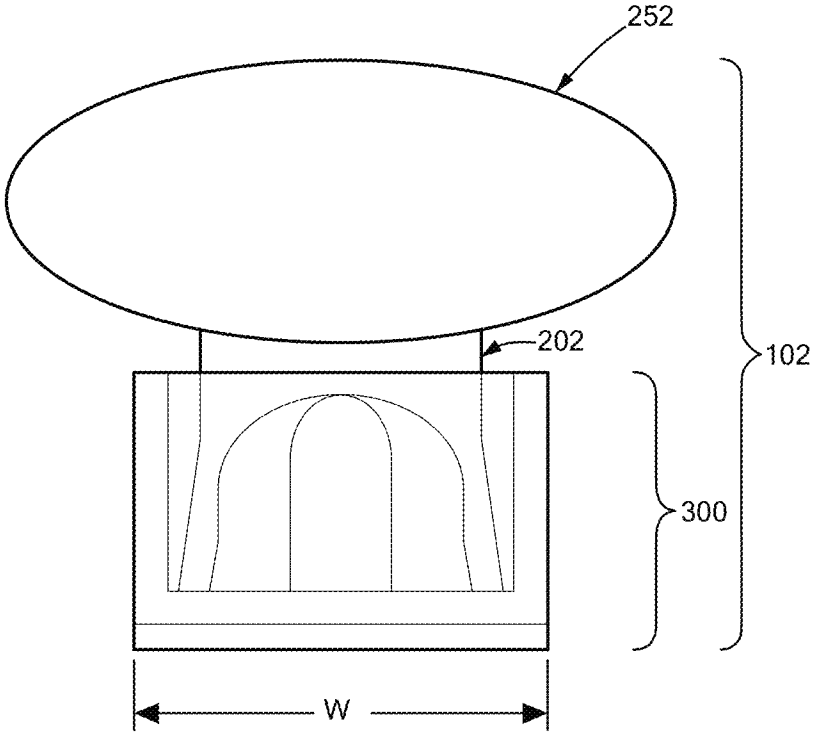
Figure 13D:
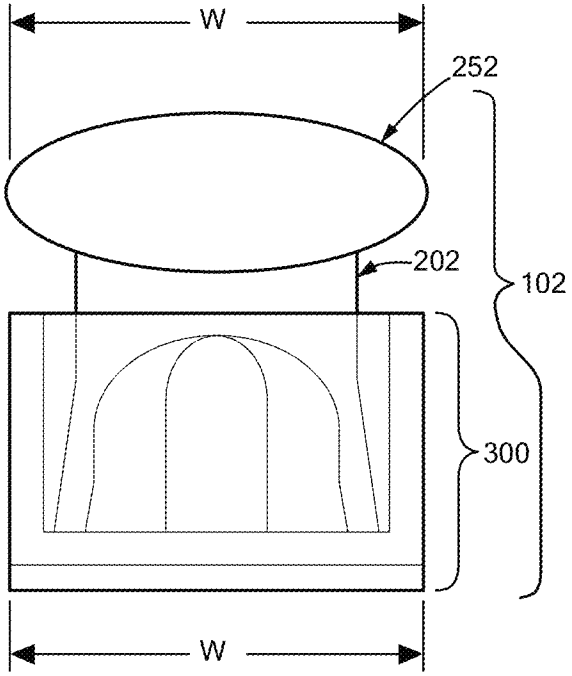

In FIG. 13A, the second dielectric portion 252 has a cross-section shape in the x-z plane that is circular. In FIG. 13B, the second dielectric portion 252 has a cross-section shape in the x-z plane that is ovaloid. In FIGS. 13A and 13B, the second dielectric portion 252 has a cross-section overall outside dimension in the x-z plane that is equal to a cross-section overall outside dimension of the first dielectric portion 202 in the x-z plane. In FIG. 13C, the second dielectric portion 252 has a cross-section overall outside dimension in the x-z plane that is greater than a cross-section overall outside dimension of the first dielectric portion 202 in the x-a plane. In FIGS. 13A, 13B and 13C, the second dielectric portion 252 has a cross-section overall outside dimension in the x-z plane that is less than the defined cross-section overall outside dimension W of the unit cell 102 in the x-z plane. In FIG. 13D, the second dielectric portion 252 has a cross-section overall outside dimension in the x-z plane that is equal to the defined cross-section overall outside dimension W of the unit cell 102 in the x-z plane. In FIG. 13E, the second dielectric portion 252 has a cross-section overall outside dimension in the x-z plane that is greater than the defined cross-section overall outside dimension W of the unit cell in the x-z plane. In any of FIGS. 13A-13E, the second dielectric portion may have a cross-section shape in the y-z plane that is the same as its cross-section shape in the x-z plane. A comparison between FIGS. 13A, 13B and FIGS. 1A-1F notably shows an absence of the neck region (see neck 216 in FIG. 1A for example) in the embodiments of FIGS. 13A and 13B. In the embodiments absent such a neck, it is contemplated that the shape of the transition region from the dielectric medium of the first dielectric portion 202 to the dielectric medium of the second dielectric portion 252 is instrumental in focusing the far field radiation pattern in a desirable manner.

While an invention has been described herein with reference to example embodiments, it will be understood by those skilled in the art that various changes may be made and equivalents may be substituted for elements thereof without departing from the scope of the claims. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Additionally, the term "comprising" as used herein does not exclude the possible inclusion of one or more additional features.

The invention claimed is:

1. An electromagnetic device, comprising:

a dielectric structure comprising:

a first dielectric portion, FDP, having a proximal end and a distal end, and a three-dimensional, 3D, shape having a direction of protuberance from the proximal end to the distal end oriented parallel with an effective z-axis of an orthogonal x, y, z coordinate system, the FDP comprising a dielectric material other than air; and a second dielectric portion, SDP, having a proximal end and a distal end, the proximal end of the SDP being disposed in contact with the distal end of the FDP to form the dielectric structure, the SDP comprising a dielectric material other than air;

wherein the SDP has a 3D shape having a first x-y plane cross-section area proximate the proximal end of the SDP, and a second x-y plane cross-section area between the proximal end and the distal end of the SDP, the second x-y plane cross section area being greater than the first x-y plane cross-section area.

2. The device of claim 1, wherein the proximal end of the SDP is disposed in direct intimate contact with the distal end of the FDP absent an intermediate dielectric medium therebetween.

3. The device of claim 1, wherein the device is operable at a defined frequency having a corresponding free space wavelength λ, and wherein the proximal end of the SDP is disposed at a distance from the distal end of the FDP that is equal to or less than: five times λ; three times λ; one times λ; or, one-half times λ.

4. The device of claim 1, further comprising:

a substrate, the dielectric structure being disposed on the substrate; and wherein the orientation of the z-axis is normal to the substrate.

5. The device of claim 1, further comprising:

a substrate, the dielectric structure being disposed on the substrate; and wherein the orientation of the z-axis is not normal to the substrate.

6. The device of claim 1, wherein the SDP has a cross-section shape in the x-z plane that: is circular; is ovaloid; is parabolic; is conical; is horn-shaped; or, mirrors the x-z plane cross-section shape of the FDP.

7. The device of claim 6, wherein:

the SDP has a cross-section shape in the x-z plane that is parabolic; and the vertex of the parabolic-shaped SDP is at the proximal end of the SDP.

8. The device of claim 1, wherein the SDP has an asymmetrical cross-section shape in the x-z plane relative to a plane of reflection of an emitted radiation associated with the device.

9. The device of claim 1, wherein the SDP has a cross-section shape in the y-z plane that is the same as its cross-section shape in the x-z plane.

10. The device of claim 1, wherein the dielectric material of the SDP has an average dielectric constant that is less than the average dielectric constant of the dielectric material of the FDP.

11. The device of claim 1, wherein the dielectric material of the SDP has an average dielectric constant that is greater than the average dielectric constant of the dielectric material of the FDP.

12. The device of claim 1, wherein the dielectric material of the SDP has an average dielectric constant that is equal to the average dielectric constant of the dielectric material of the FDP.

13. The device of claim 1, wherein the SDP comprises: a flat distal end; a convex distal end; or, a concave distal end.

14. The device of claim 1, wherein the SDP is attached to the FDP, disposed in direct intimate contact with the FDP absent an air gap therebetween, or is at least partially embedded within the FDP.

15. The device of claim 1, further comprising:

an electromagnetically reflective structure comprising an electrically conductive structure and at least one electrically conductive electromagnetic reflector that is integrally formed with or is in electrical communication with the electrically conductive structure;

wherein each of the at least one electrically conductive electromagnetic reflector forms a wall that defines and at least partially circumscribes a recess having an electrically conductive base that forms part of or is in electrical communication with the electrically conductive structure; and wherein a respective one of the dielectric structure is disposed within a given one of the recess and is disposed on the respective electrically conductive base.

16. The device of claim 15, wherein the electromagnetically reflective structure comprises a plurality of the at least one electrically conductive electromagnetic reflector, and the associated respective one of the dielectric structure comprises a plurality of the dielectric structure, forming an array of a plurality of the dielectric structure.

17. The device of claim 16, wherein the array of dielectric structures are arranged with a center-to-center spacing between neighboring dielectric structures in accordance with any of the following arrangements:

equally spaced apart relative to each other in an x-y grid formation;

spaced apart in a diamond formation;

spaced apart relative to each other in a uniform periodic pattern;

spaced apart relative to each other in an increasing or decreasing non-periodic pattern;

spaced apart relative to each other on an oblique grid in a uniform periodic pattern;

spaced apart relative to each other on a radial grid in a uniform periodic pattern;

spaced apart relative to each other on an x-y grid in an increasing or decreasing non-periodic pattern;

spaced apart relative to each other on an oblique grid in an increasing or decreasing non-periodic pattern;

spaced apart relative to each other on a radial grid in an increasing or decreasing non-periodic pattern;

spaced apart relative to each other on a non-x-y grid in a uniform periodic pattern; or spaced apart relative to each other on a non-x-y grid in an increasing or decreasing non-periodic pattern.

18. The device of claim 16, wherein neighboring SDPs of the array of dielectric structures are connected via a relatively thin dielectric connecting structure relative to an overall dimension of the respective connected SDP.

19. The device of claim 16, wherein voids between adjacent ones of the dielectric structures forming the array of dielectric structures comprise a non-gaseous dielectric material.

20. The device of claim 19, wherein the non-gaseous dielectric material in the voids has a dielectric constant that is equal to or greater than air and equal to or less than the dielectric constant of an associated SDP of the dielectric structures.

21. The device of claim 16, further comprising:

at least one signal feed disposed electromagnetically coupled to a respective one of the FDP;

wherein each associated signal feed and FDP is configured to radiate an E-field having an E-field direction line;

wherein closest adjacent neighboring E-field direction lines are parallel with each other;

wherein a first pair of closest diagonal neighboring E-field direction lines are parallel with each other; and wherein a second pair of closest diagonal neighboring E-field directions lines are aligned with each other.

22. The device of claim 1, wherein the SDP has a cross-section overall outside dimension in the x-z plane that is greater than a cross-section overall outside dimension of the FDP in the x-z plane.

23. The device of claim 1, wherein the device is a dielectric resonant antenna.

24. The device of claim 14, wherein the SDP is fully embedded within the FDP such that the distal end of the SDP is the distal end of the dielectric structure.

25. The device of claim 24, wherein the SDP has a cross-section shape in the x-z plane that is circular, or ovaloid.

26. The device of claim 24, wherein the SDP has a cross-section shape in the y-z plane that is the same as its cross-section shape in the x-z plane.

27. The device of claim 24, wherein the SDP has a cross-section overall outside dimension in the x-z plane that is equal to or greater than a cross-section overall outside dimension of the FDP in the x-z plane.

28. The device of claim 24, further comprising:

an electromagnetically reflective structure comprising an electrically conductive structure and at least one electrically conductive electromagnetic reflector that is integrally formed with or is in electrical communication with the electrically conductive structure;

wherein each of the at least one electrically conductive electromagnetic reflector forms a wall that defines and at least partially circumscribes a recess having an electrically conductive base that forms part of or is in electrical communication with the electrically conductive structure;

wherein a respective one of the dielectric structure is disposed within a given one of the recess and is seated on the respective electrically conductive base; and wherein the dielectric structure and an associated electromagnetically reflective structure define a unit cell having a defined cross-section overall outside dimension in the x-z plane.

29. The device of claim 28, wherein the SDP has a cross-section overall outside dimension in the x-z plane that is: less than the defined cross-section overall outside dimension of the unit cell in the x-z plane; equal to the defined cross-section overall outside dimension of the unit cell in the x-z plane; or, greater than the defined cross-section overall outside dimension of the unit cell in the x-z plane.

30. The device of claim 24, wherein the SDP has a cross-section shape in the y-z plane that is the same as its cross-section shape in the x-z plane.

31. The device of claim 1, wherein the dielectric structure is an all-dielectric structure.

* * * * *